US011111097B2

(12) United States Patent
Magee

(10) Patent No.: US 11,111,097 B2
(45) Date of Patent: Sep. 7, 2021

(54) DISPENSER APPARATUS FOR ADHESIVE TAPE

(71) Applicant: Carlton Packaging LLP, Milton Keynes (GB)

(72) Inventor: Marcus Magee, Milton Keynes (GB)

(73) Assignee: CARLTON PACKAGING LLP, Buckinghamshire (GB)

( * ) Notice: Subject to any disclaimer, the term of this patent is extended or adjusted under 35 U.S.C. 154(b) by 123 days.

(21) Appl. No.: 16/415,262

(22) Filed: May 17, 2019

(65) Prior Publication Data

US 2019/0352122 A1 Nov. 21, 2019

(30) Foreign Application Priority Data

May 18, 2018 (GB) ..... 1808073

(51) Int. Cl.
*B65H 35/00* (2006.01)

(52) U.S. Cl.
CPC ..... *B65H 35/0053* (2013.01); *B65H 35/0073* (2013.01)

(58) Field of Classification Search
CPC ... B65H 35/00–35/10; Y10T 156/1352; Y10T 156/1357; Y10T 156/1361; Y10T 156/1788; Y10T 156/179; Y10T 156/1795; Y10T 156/18; B32B 37/0038; B32B 2038/0056; B29C 65/50; B29C 65/5092
See application file for complete search history.

(56) References Cited

U.S. PATENT DOCUMENTS 1,998,736 A * 4/1935 Reed ..... B65H 35/0046 118/42
2,487,351 A * 11/1949 Marsh ..... B65H 35/0053 156/526
2,655,372 A * 10/1953 Hempel ..... B65H 35/0066 33/741
3,875,895 A * 4/1975 Todd ..... B65H 35/0046 118/40
4,059,210 A * 11/1977 Deering, Jr. ..... B65H 35/0026 225/47
2002/0092608 A1* 7/2002 Erickson ..... B44C 1/1725 156/247
2014/0026810 A1* 1/2014 Lazzaroni ..... B29C 65/5092 118/231

* cited by examiner

*Primary Examiner* — John L Goff, II
(74) *Attorney, Agent, or Firm* — Woodard, Emhardt, Henry, Reeves & Wagner, LLP

(57) ABSTRACT

The invention relates to apparatus and a method for applying a length of adhesive tape with a water activated adhesive coating using a handheld dispensing apparatus. The apparatus allows a first portion including a leading end of the said length of tape to be fed from a tape supply through a dispensing outlet of the apparatus by operating user actuation means to operate feed means of the apparatus and a further portion of the said length of tape is dispensed by causing relative movement between the apparatus and the said item and operating user actuation means to operate a cutting station of the apparatus to separate the trailing edge of the said length of tape from the remainder of the tape supply and the apparatus and thereby allow the length of tape to be adhered to the item, such as a cardboard packaging box.

9 Claims, 23 Drawing Sheets

DISPENSER APPARATUS FOR ADHESIVE TAPE

Figure 1A:
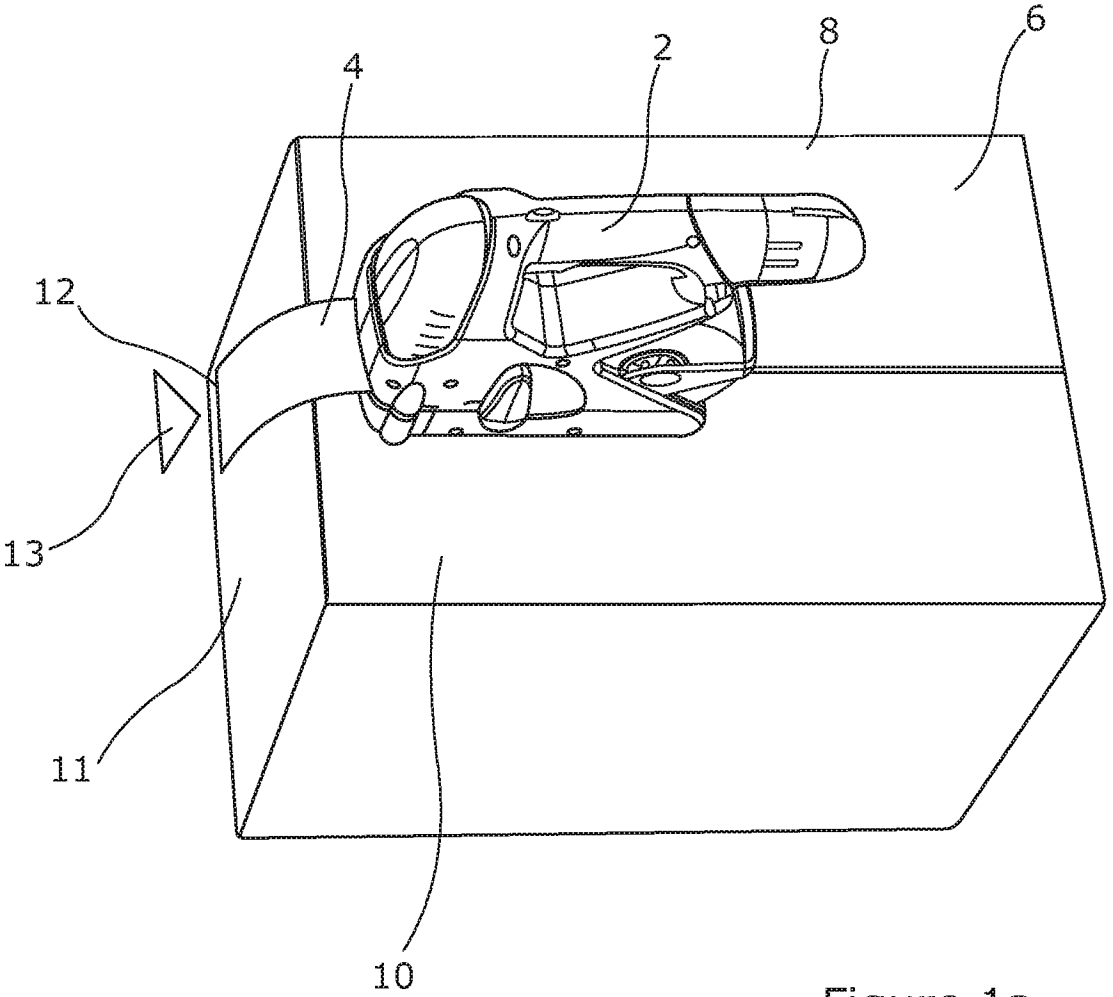

The invention to which this application relates is dispenser apparatus for use in the dispensing of lengths of tape from a roll of tape which is located with the apparatus. In particular, although not necessarily exclusively, the dispenser apparatus includes means for applying a liquid to a surface of the tape so as to activate an adhesive coating on the said surface and thereby render the same into an adhesive state at the time of applying the tape to an item, such as, for example, a cardboard box to seal the lid flaps of the box together, to secure wrapping or packaging material together to form a parcel or indeed any purpose for which the use of the tape is of advantage.

The provision of apparatus to allow the dispensing of lengths of tape and, at the same time, activate an adhesive coating on the said tape is known. The conventional form of the apparatus can be split into two types, a first type being a relatively large scale powered dispensing apparatus which is designed to be located on a work surface and to form a dispensing "station" from which the adhesive tape is dispensed, and a second type which is of a smaller size and is manually operated and which is provided to be used in the dispensing of a relatively "lightweight" tape and which can be relatively easily broken or cut from the roll of tape to allow the separated length of tape to then be applied. While this second type of apparatus is suitable for relatively low volume usage as soon as there is any significant demand for frequent dispensing and application of lengths of tape, and/or for use with stronger and possibly reinforced tape, the second type of apparatus can quickly become unsuitable for use and, as a result, this type of apparatus is not commonly used in commercial packaging.

Thus, the first type of tape dispensing apparatus is commonly used for commercial packaging purposes and in this form of apparatus there is typically provided a reservoir of liquid, typically water, which is to be applied to the adhesive coating on the surface of the tape so as to activate the same. Most typically this activation occurs prior to the length of tape leaving the apparatus so that as the tape leaves the apparatus, the water activation of the adhesive has at least commenced. In addition, the apparatus includes a holder for a roll of said tape and the leading edge of the tape is passed through a series of rollers, at least one of which is driven to move the predetermined length of tape through the apparatus and past the water application point. Cutting apparatus is provided to move a blade selectively to and through the tape to define a separated length of the tape and drive means drive the separated length of tape out of the apparatus outlet and the separated length is required to be grasped by the user and then moved to, and applied onto, the selected item.

While this type of apparatus is well-known and frequently used, it is found that due to the size, the apparatus is provided in a fixed location which, in conjunction with the limited time available during which the dispensed length of tape can be applied to the item after the water has been applied to the adhesive, means that the item on which the tape is to be used, is required to be moved to the location of the apparatus. This can be difficult if the items are relatively bulky and heavy. Furthermore, the need for the tape to be handled by the user to a significant extent in order to move the separated length of tape onto the item is in itself problematic as the effect of the water which has been applied onto the adhesive to activate the same can also soften the tape base material and therefore increase the difficulty of handling of the length of tape.

The Applicant has therefore identified that while in principle, this form of tape dispenser apparatus provides the required result, the apparatus is unsuitable and impractical for many used and hence reduces the possible usage of the same.

A further problem is that frequently the tape which is used is reinforced by a matrix of glass fibre or other strands of material and which, during the dispensing of the tape, can make it more difficult to cut through the tape to separate a length of the tape from the roll.

An aim of the present invention is therefore to provide an improved form of tape dispensing apparatus which allows a length of tape to be separated from a tape supply and made available for application to an item. A further aim is to provide the apparatus in a form in which the same can be hand held and therefore moveable with respect to the item to which the tape is to be applied. A further aim of the invention is to provide the apparatus in a form which allows the dispensing of a length of tape, the separation of the length of tape from the tape supply and the application of the same to an item with a minimum of hand contact with the tape being required.

A yet further aim of the present invention is to allow a supply of liquid to be reliably provided in the apparatus so as to allow the same to be applied to an adhesive coating on a surface of the tape so as to activate the adhesive.

In a first aspect of the invention, there is provided apparatus for the supply, activation and dispensing of a length of adhesive tape, said apparatus including feed means in order to move a leading end of the said length of tape away from a tape supply held on the apparatus and towards a dispensing outlet, a liquid application station to allow liquid to be applied to an adhesive coating on the said adhesive tape as it passes said station, a cutting station to selectively cut the tape to define the said length of adhesive tape, said liquid application station and cutting station located intermediate the said tape supply and the dispensing outlet and wherein user actuation means are provided to allow selective operation of the feed means to sequentially move the said leading end through the dispensing outlet followed by operation of the cutting station to define the said length of adhesive tape with liquid applied to the said adhesive coating of the same.

In one embodiment, operation of the user actuation means causes the said leading end of the length of tape to be dispensed from the apparatus by operation of the feed means and thereafter the feed means are disengaged and relative movement of the apparatus with respect to an item to which the leading end of the tape is adhered, allows the dispensing of the said length of tape.

In one embodiment, a further operation of the user actuation means causes operation of the cutting station to separate the length of tape from the tape supply.

In one embodiment the same drive means is used to operate the feed means and the cutting station.

In one embodiment, the liquid supply station is fed with liquid from a liquid reservoir and the station includes a liquid absorbing and/or holding material so that the adhesive coating of the tape contacts the same to take on liquid therefrom as the tape is moved through the apparatus.

Typically the liquid application station is located intermediate the cutting station and the dispensing outlet.

Typically the apparatus includes a housing in which the components as described above are located in a desired sequence and in one embodiment the housing includes a cavity for the receipt of the tape supply therein, typically in the form of a roll of the tape.

In one embodiment, the tape supply is partially located in the cavity by a carrier which is moveable from an open position to a closed position and in one embodiment, when in the open position, the carrier acts as a carrier for the said roll of tape and, as the carrier and a new roll of tape supported thereby, are moved to a closed position, the roll of tape is also moved into the cavity to the required location for use with the apparatus.

Typically, the user actuation means are provided as a switch or trigger and most typically adjacent to a handle portion of the housing. In one embodiment the user actuation means are biased to a first position and which can be moved to a second position when required by the user to operate the apparatus.

In one embodiment, the user control means operates a clutch system connected to a drive means in the form of a motor located in the housing in which allows selective connection and disconnection of the motor from the feed means which typically comprises a series of rollers. Typically, when the motor is connected, the tape leading edge is driven out of the apparatus and when the motor is disengaged, the rollers are free-wheeling in order to allow the tape to be dispensed from the apparatus by the relative movement of the apparatus and the item with a part of the dispensed tape adhered to the item. When the required length of tape has been dispensed, operation of the user actuation means causes the drive means for the cutting station, which may be the same motor, or a second motor, to be engaged to move a cutting blade onto the tape and to separate a length of tape including the portion which has already been dispensed from the remaining tape supply held within the apparatus.

Typically, a greater part of the said length of tape is dispensed from the apparatus as a result of the relative movement between the apparatus and the item rather than the length which is dispensed by the driven movement of the tape through the apparatus. Typically as the tape is dispensed with the user gripping, moving and operating the apparatus with one hand, the user can use their other hand to smooth down and ensure that the dispensed tape adheres to the surface of the item.

In a further aspect of the invention there is provided apparatus for the supply, activation and dispensing of a length of adhesive tape, said apparatus including feed means, a cutting station to cut the tape and define the length of the tape which is to be dispensed from the apparatus, and wherein the apparatus is provided with a housing with a handle portion and user actuation means so as to allow the apparatus to be hand held in use and to be operated via the selective movement of the user actuation means.

Typically the apparatus also includes a liquid application station to apply liquid to an adhesive coating on the tape as the tape passes the said station In a yet further aspect of the invention there is provided apparatus for the supply, activation and dispensing of a length of adhesive tape, said apparatus including feed means, a cutting station to cut the tape and define the length of the tape which is to be dispensed from the apparatus, and wherein the apparatus is provided with a housing with a handle portion and user actuation means so as to allow the apparatus to be hand held in use and relative movement between the apparatus and an item to which a portion of the said length of tape is applied allows the remainder of the length of tape to be applied directly from the apparatus to the item.

Typically therefore the application of the said remainder of the length of tape is achieved in a hands free manner.

In a further aspect of the invention, there is provided a method for applying a length of adhesive tape with a water activated adhesive coating using a handheld dispensing apparatus, said method comprising the steps of dispensing a first portion including a leading end of the said length of tape from a tape supply through a dispensing outlet of the apparatus by operating user actuation means to operate feed means of the apparatus, wherein a further portion of the said length of tape is dispensed by causing relative movement between the apparatus and the said item and operating user actuation means to operate a cutting station of the apparatus to separate the trailing edge of the said length of tape from the remainder of the tape supply and the apparatus.

In one embodiment the method includes passing the tape through a liquid application station which is provided in the apparatus to activate a coating of adhesive on said tape.

Figure 2:
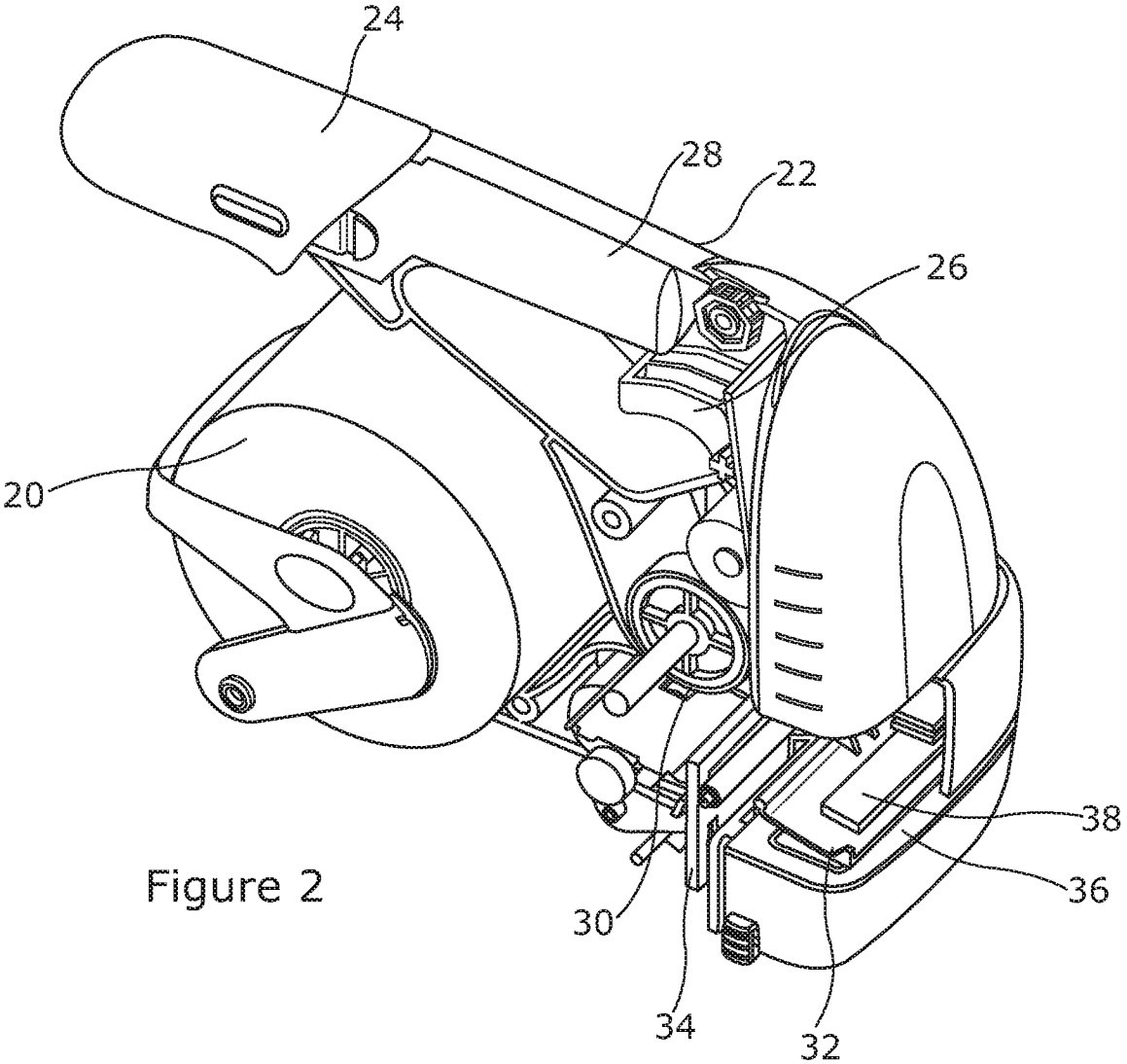
Figure 3B:
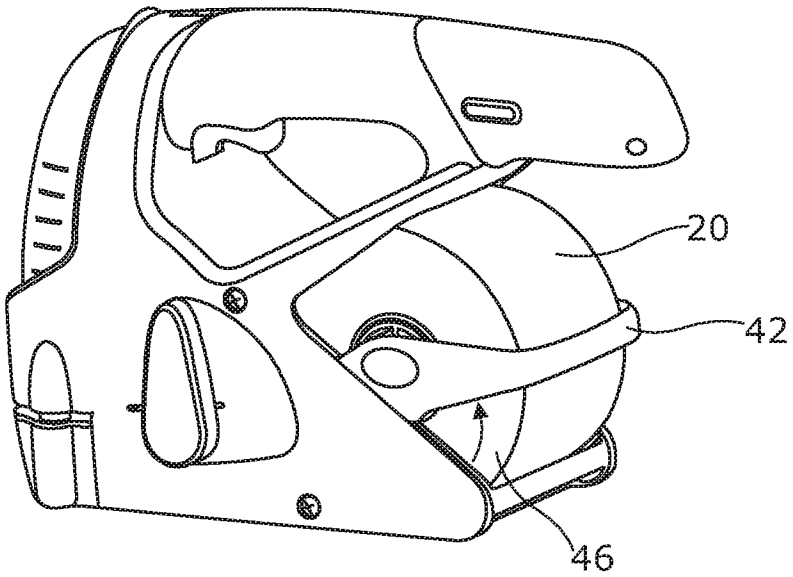
Figure 3A:
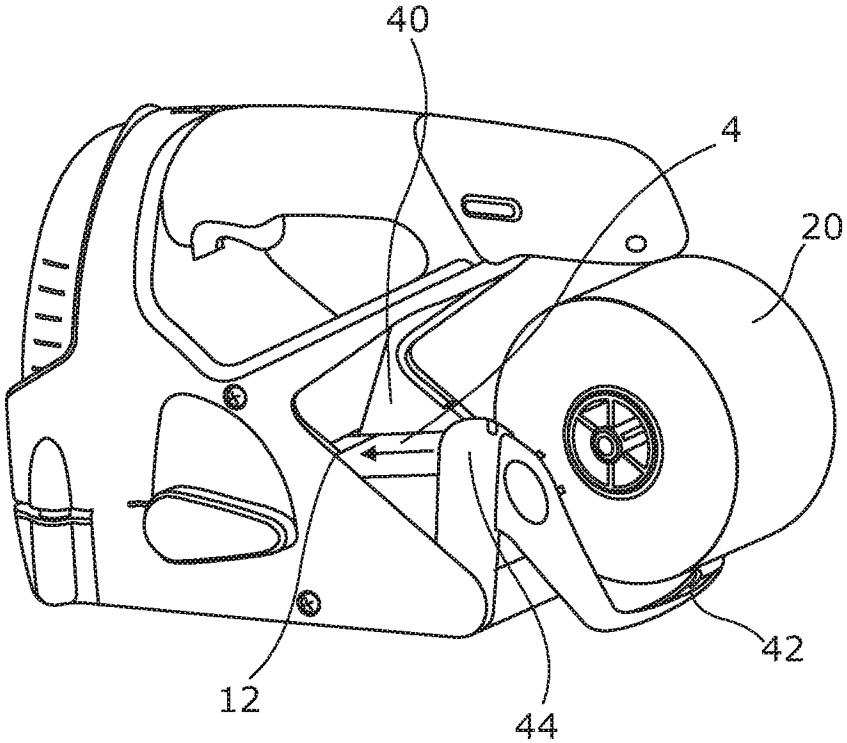
Figure 3C:
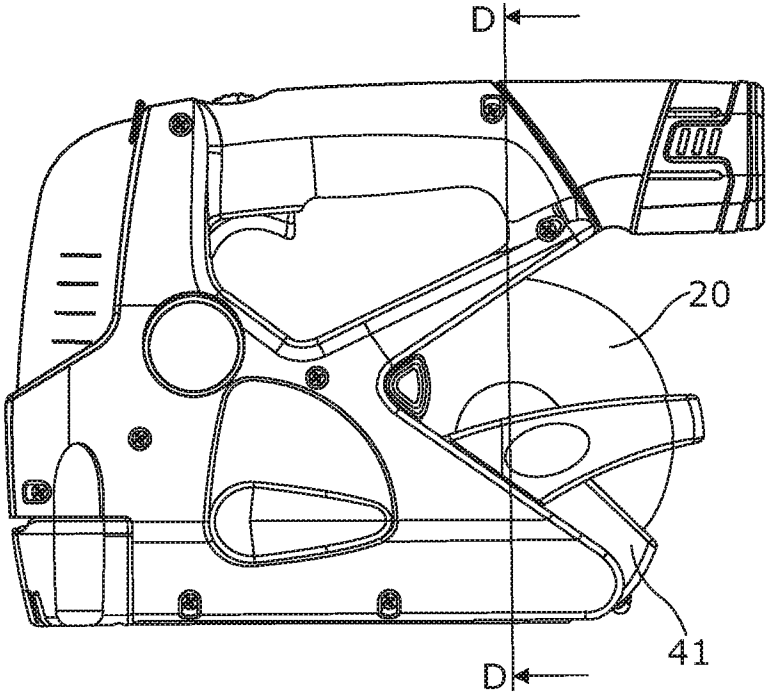
Figure 3D:
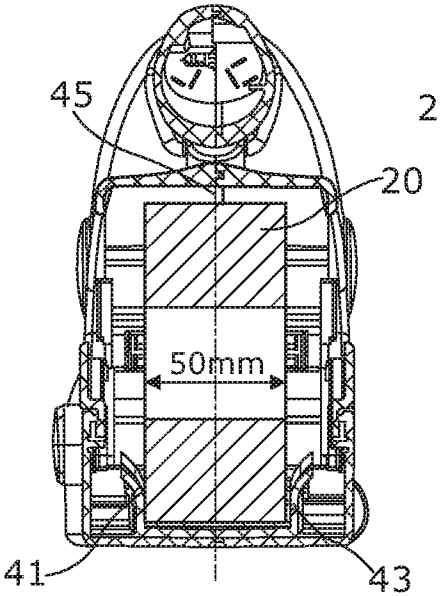
Figure 3E:
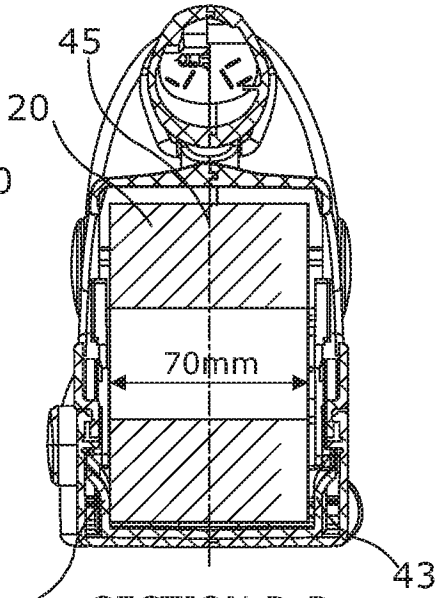
Figure 3F:
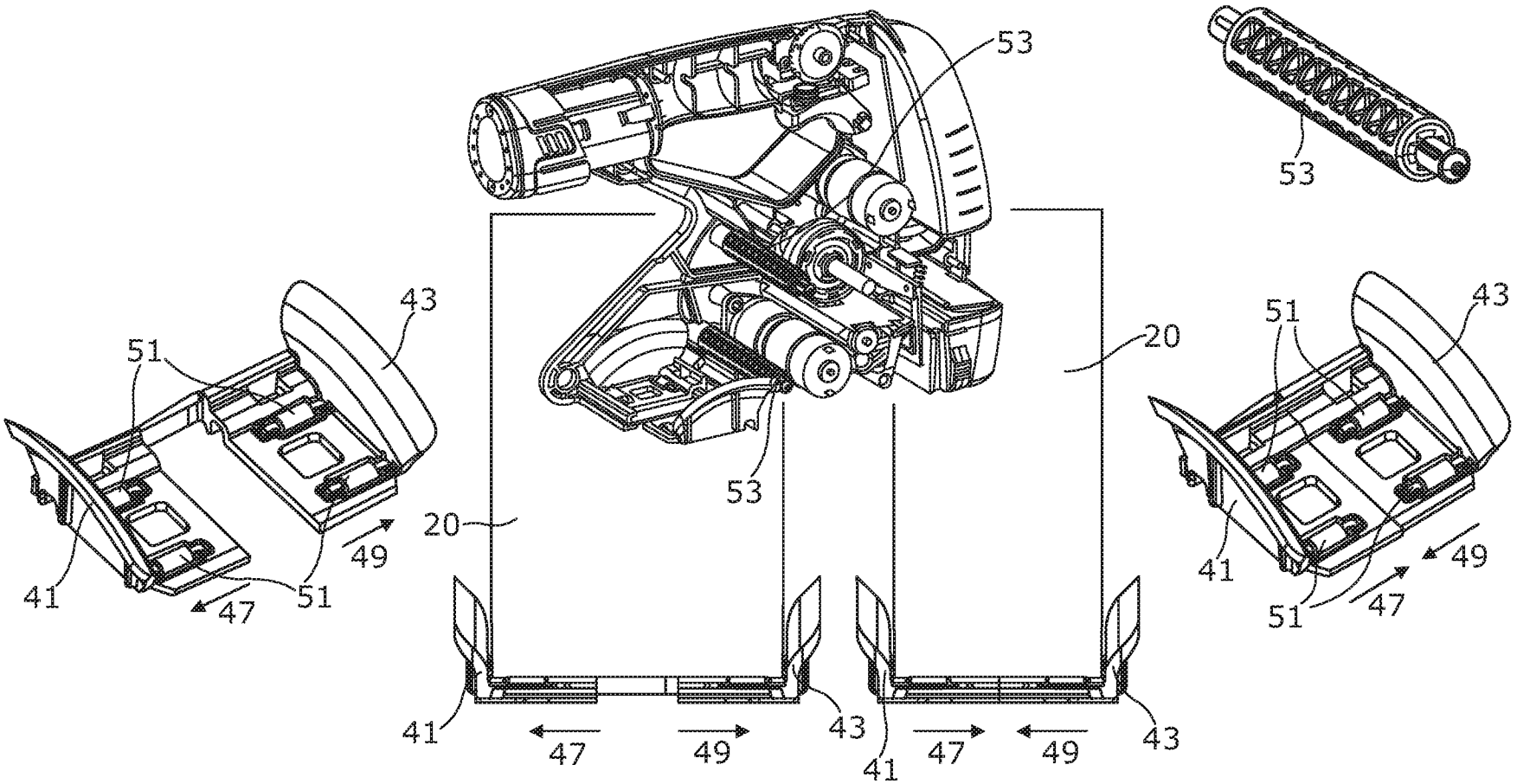
Figure 4B:
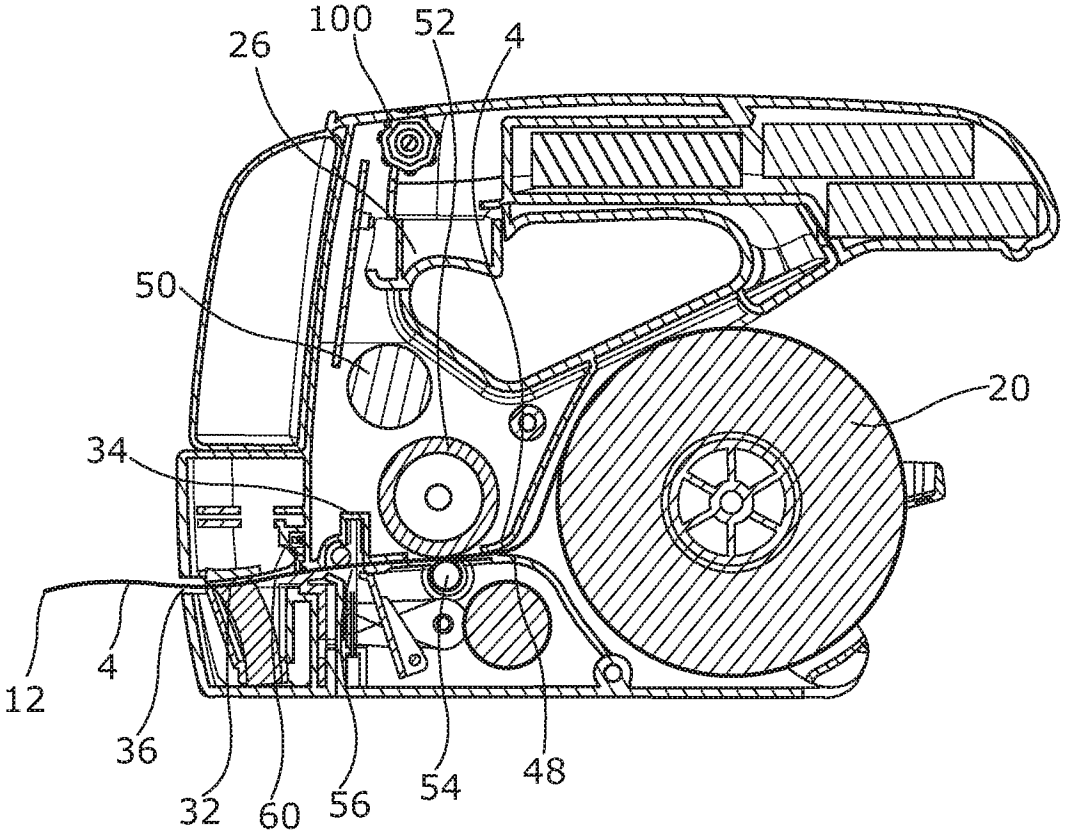
Figure 4A:
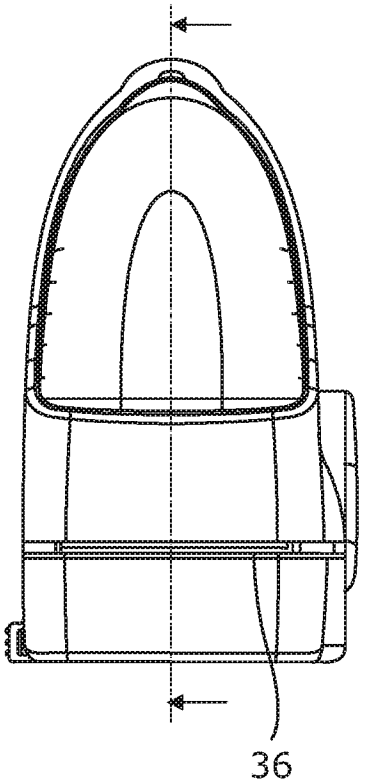
Figure 5A:
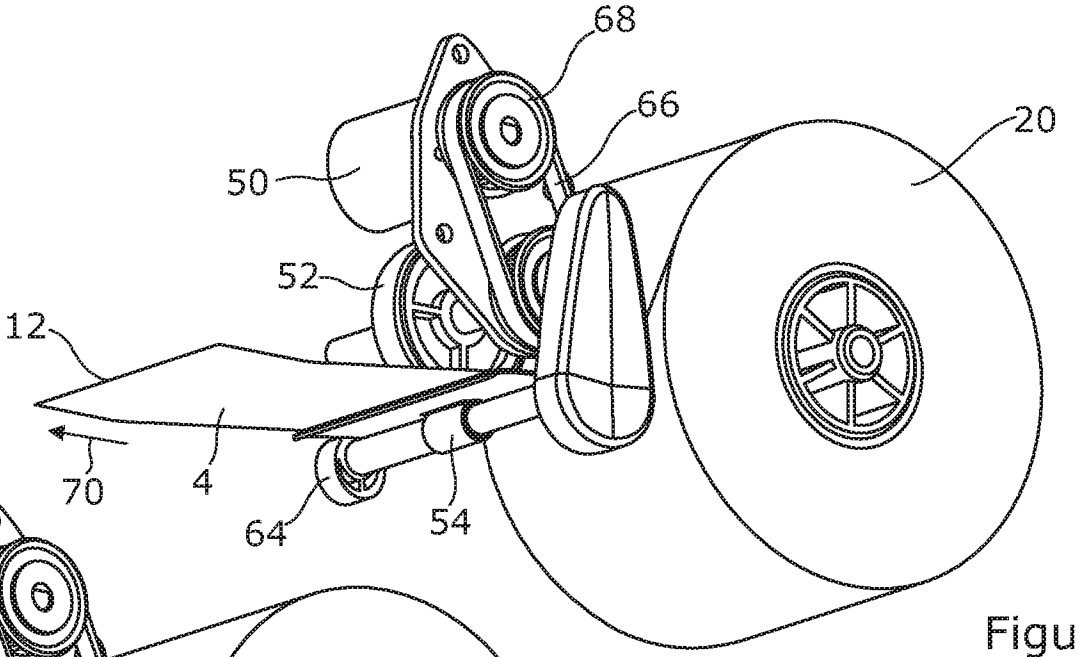
Figure 5B:
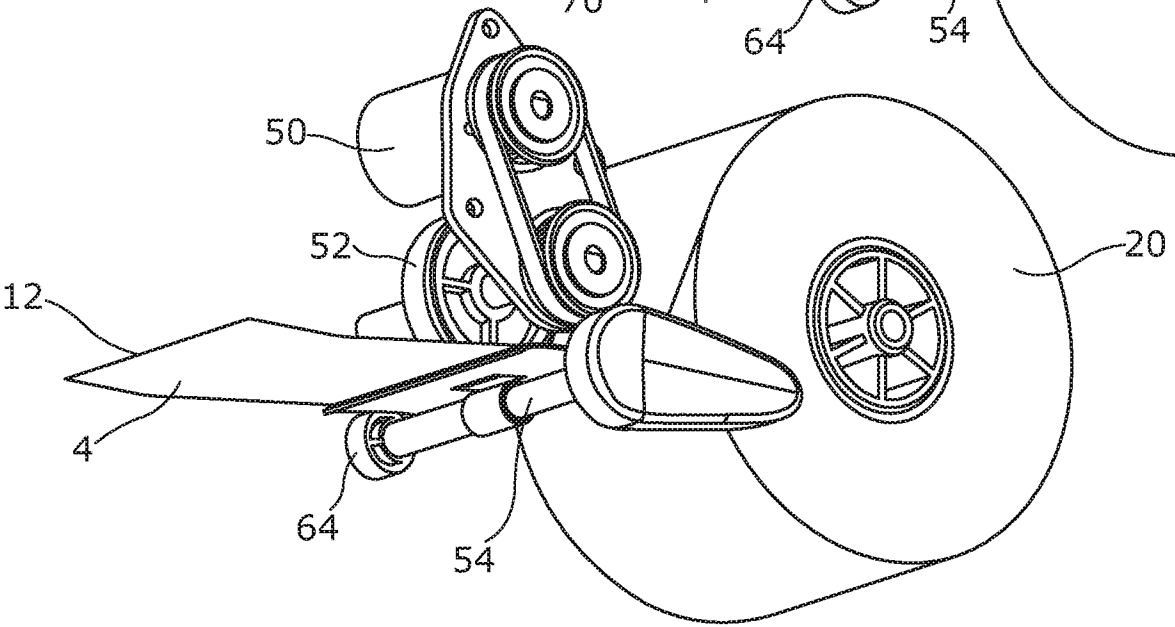
Figure 6A:
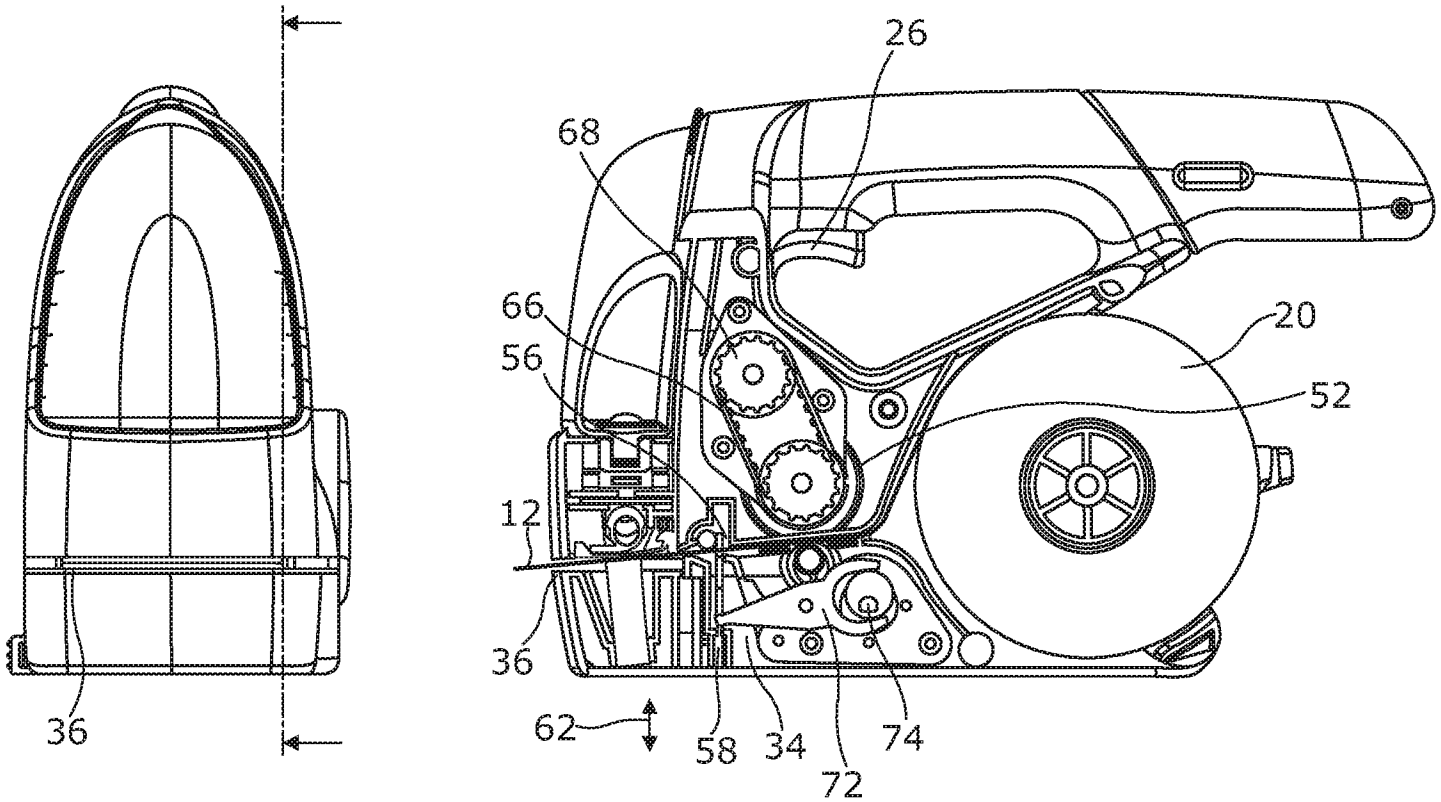
Figure 6B:
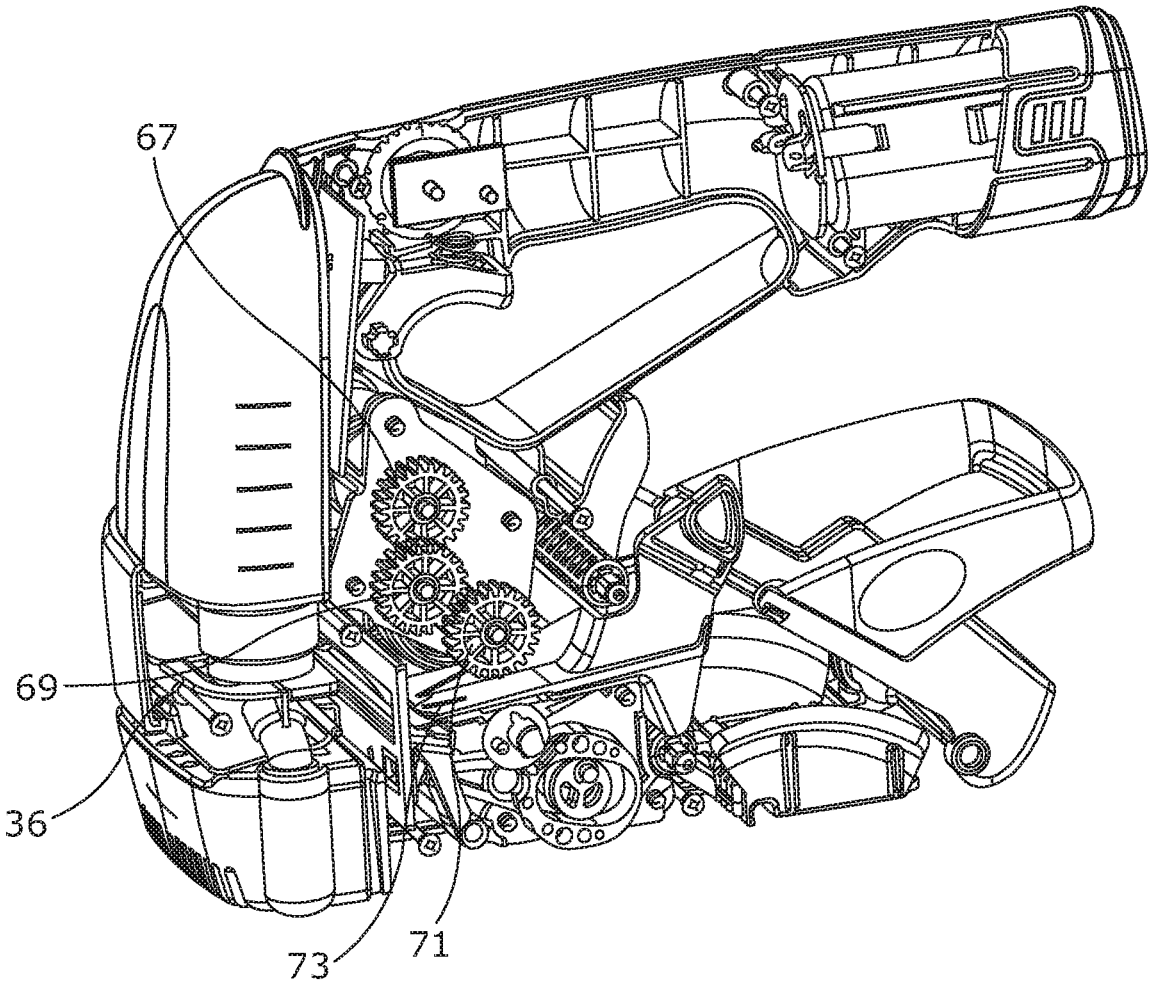
Figure 8B:
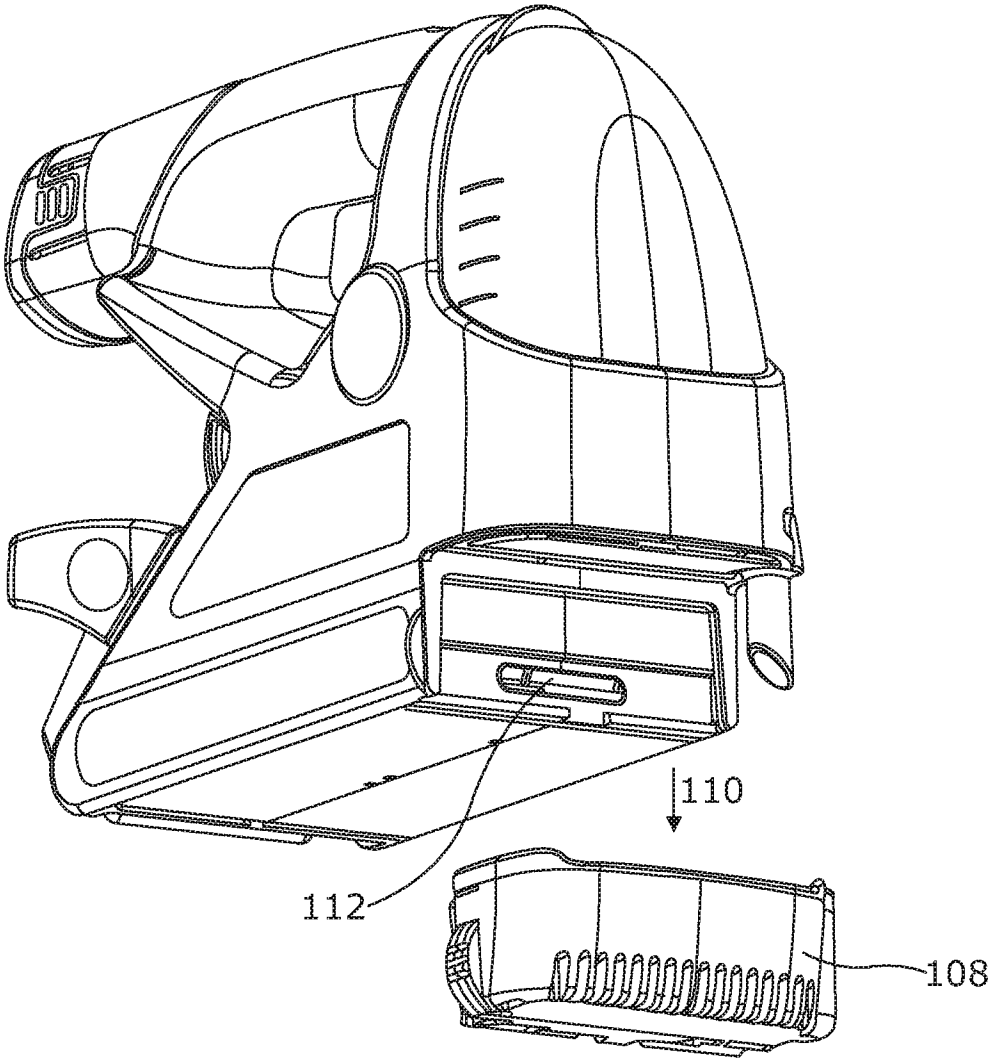
Figure 8A:
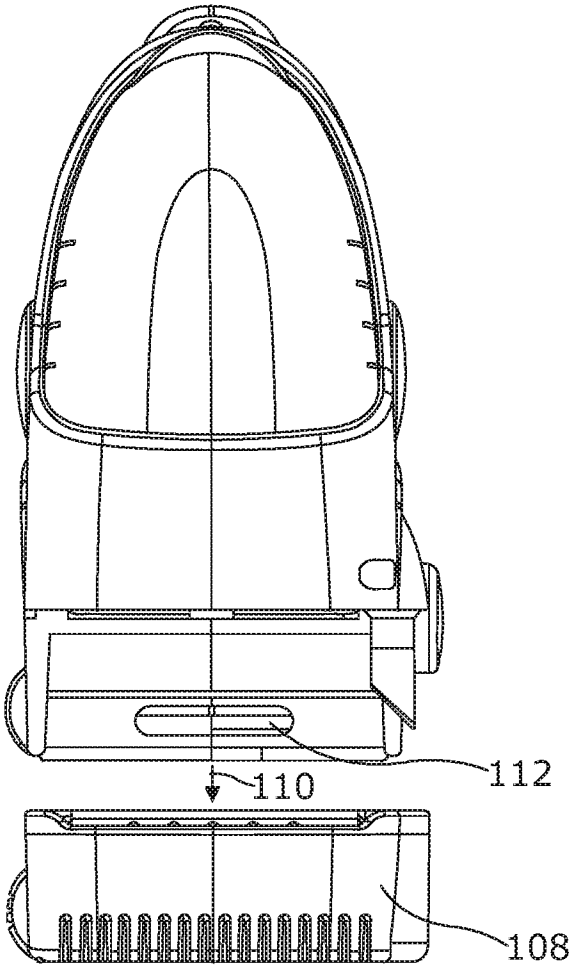

Specific embodiments of the invention are now described with reference to the accompanying drawings wherein;

FIGS. 1*a-d* illustrates schematically the use of the apparatus in accordance with the invention;

FIG. 2 illustrates part of the housing and internal components of the apparatus in accordance with one embodiment of the invention;

FIGS. 3*a-f* illustrate the fitting of a tape supply with the apparatus of FIG. 2, FIGS. 4*a* and *b* illustrate the passage of the tape through the apparatus of FIG. 2;

FIGS. 5*a-b* illustrate the pinch roller mechanism of the apparatus of FIG. 2;

FIGS. 6*a-b* illustrate the drive means of the apparatus in two embodiments;

FIGS. 7*a-k* illustrate components of the liquid delivery station of the apparatus of FIG. 2;

FIGS. 8*a-b* illustrate the provision of a cleaning access in the housing; and FIGS. 9*a-g* illustrate a pinch roller and jockey wheel drive assembly for the dispensing of the tape in accordance with one embodiment.

Figure 1B:
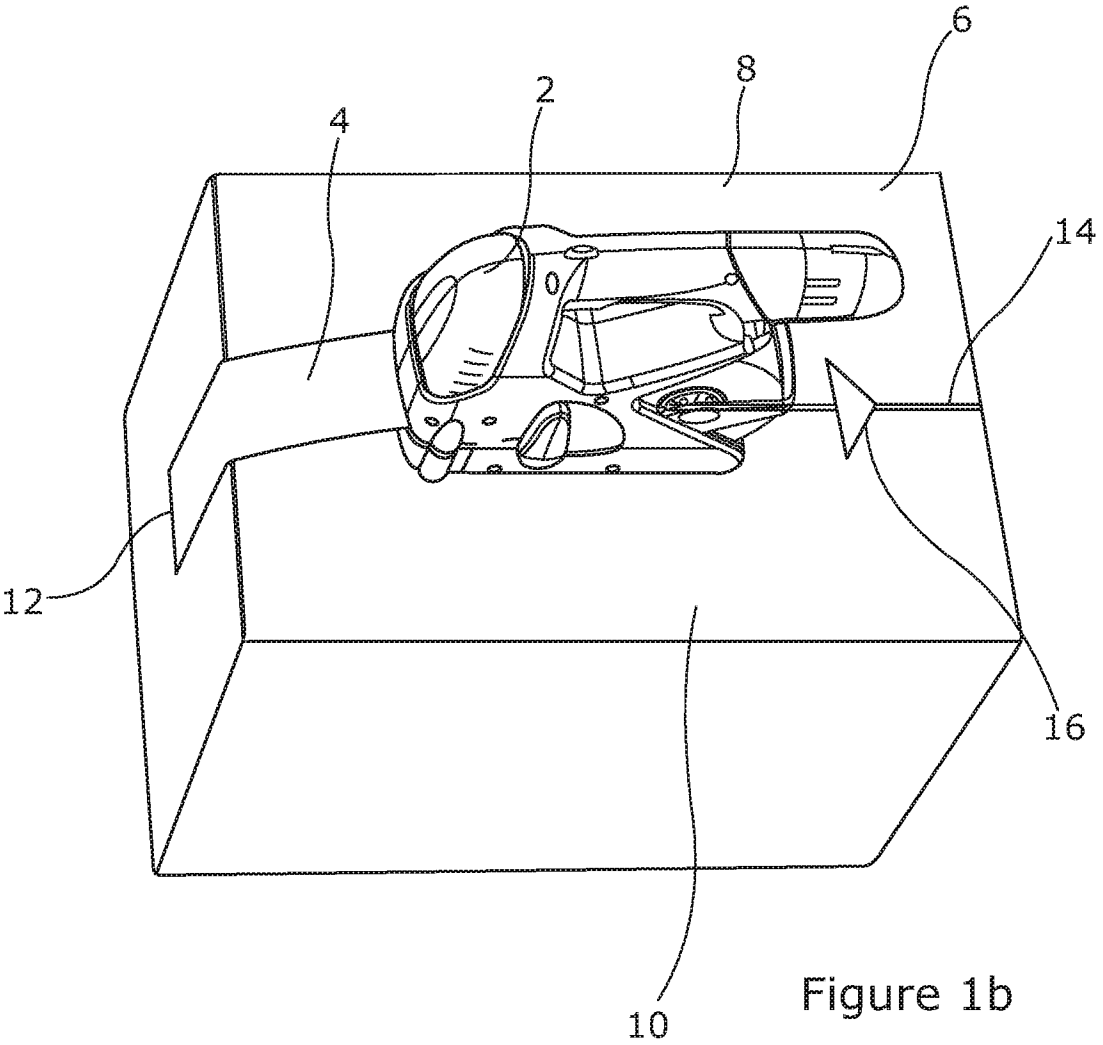
Figure 1C:
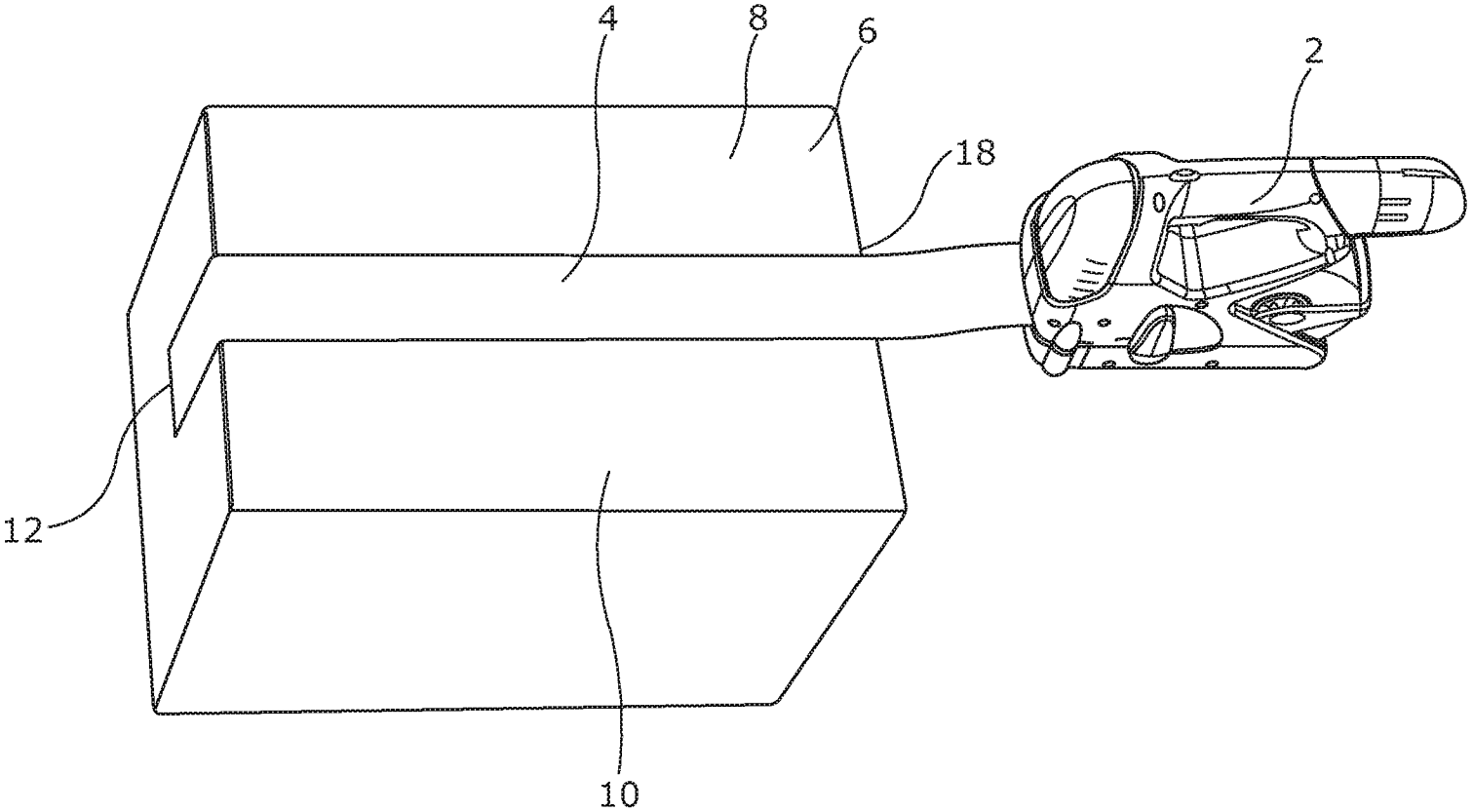
Figure 1D:
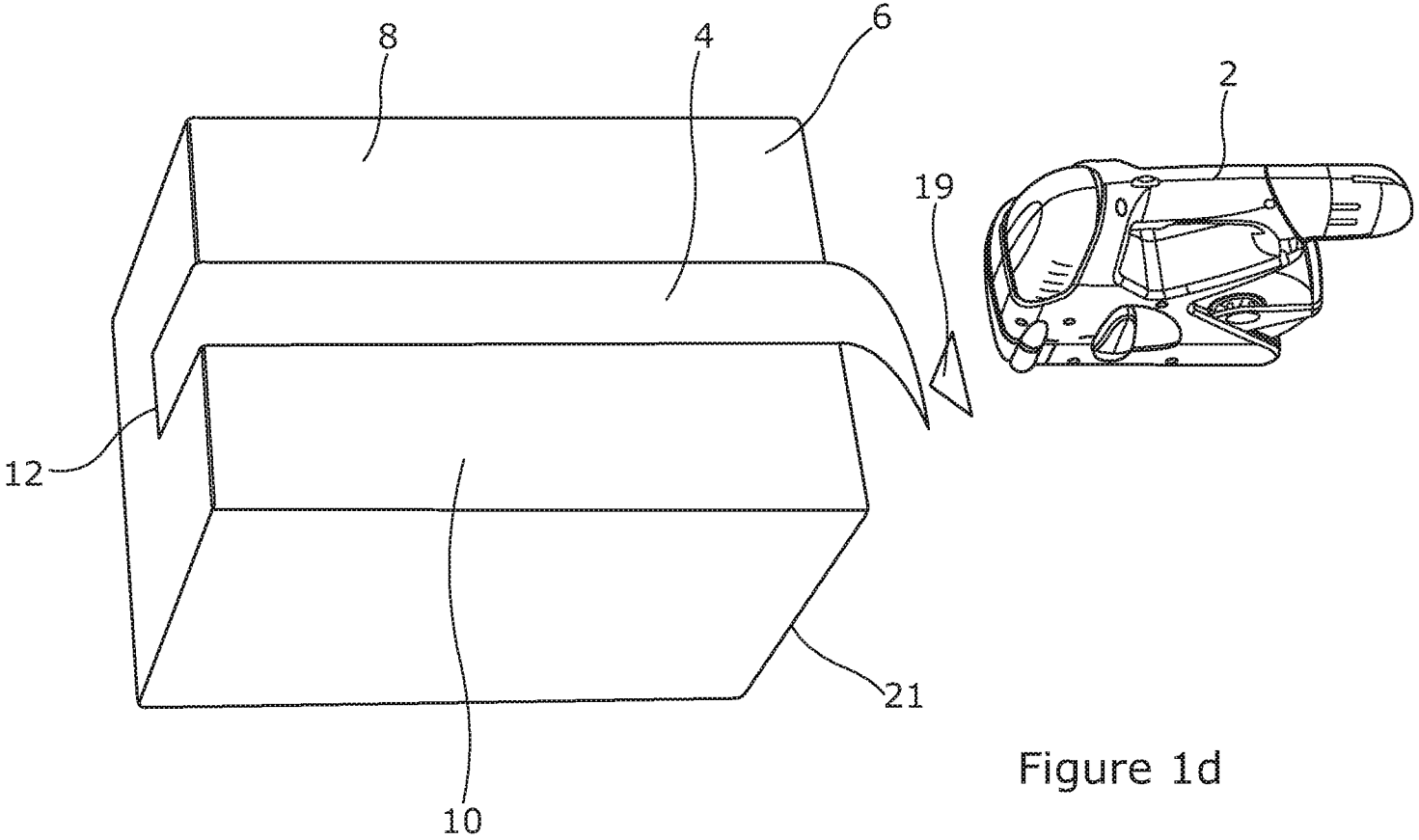

Referring firstly to FIGS. 1*a-d* there is illustrated schematically, the use of apparatus 2 in accordance with the invention to apply a length of tape 4 to an item 6 which in this case is a cardboard box with the tape being used to seal together the top flaps 8, 10 of the same. As shown, a leading end 12 of the tape which is wetted has already been dispensed having been driven out from the apparatus outlet by powered feed means by the user operating a trigger switch on the apparatus 2 so that the tape can be applied to the side wall 11 as indicated by arrow 13 in FIG. 1*a*. With the user still gripping the trigger, the apparatus 2 is then moved upwardly to flaps 8,10 to allow the tape to be placed across and along the gap 14 between the same. By this stage although the trigger switch is still gripped by the user, the powered feed sequence for the leading end of the tape has stopped and as it is desired for the tape to be adhered along the length of the gap 14 then relative movement between the item 6 and the apparatus, (which is achieved in this embodiment by moving the apparatus 2 in the direction of arrow 16 as shown in FIG. 1*b*), causes the tape 4 to be freely dispensed from the apparatus 2 until the apparatus 2 reaches the end 18 of the flaps 8,10 as shown in FIG. 1*c* and, by keeping the apparatus 2 close to the top surface of the box as this movement is performed, the tape 4 is also contacted with the box to adhere to the same and this can further be ensured by the user running their free hand along the tape 4 to engage the same onto the flaps 8,10. When the end position 18 is reached, the user moves the apparatus further beyond the item 6 as shown in FIG. 1*c* and releases the trigger switch of the apparatus which causes a cutting blade in the apparatus 2 to be operated to separate the dispensed length of tape 4 from the tape supply in the apparatus as shown in FIG. 1*d* at arrow 19 and this end of the length of tape 4 can then be fully adhered to the side wall 21 of the box.

One embodiment of the apparatus 2 in accordance with the invention is now described with reference to the remaining drawings.

In FIG. 2 there is shown part of the housing 22 of the apparatus with half of the same removed in order to allow the internal components to be visible. These components include a tape supply 20 in the form of a roll of the tape 4 and one or more power cells for the drive means held in a compartment 24. A user actuation means in the form of a trigger 26 is located adjacent handle portion 28 so that the trigger can be operated by the same hand of the user that is used to grip the handle portion. Feed and guide means 30 for the tape 4 are provided which allow the guided movement of the tape 4 towards a cutting station 34 and water dispensing station 32 and then a dispensing outlet 36. A heater element 38 may also be provided to aid activation of the adhesive coating on the tape.

Referring now to FIGS. 3*a-f* there is illustrated the manner in which the tape supply 20 can be fitted to the apparatus. The apparatus includes a cavity 40 and the housing includes a carrier portion 42 which is pivotally movable with respect to the remainder of the housing at pivot locations 44. The FIG. 3*a* illustrates the carrier 42 in an open position and the roll of tape 20 is placed therein and the leading edge 12 of the tape 4 is placed into an open receiving slot in the pinch roller assembly. The roll of tape 20 is then moved into the cavity 40 by pivotally moving the carrier to the closed position by movement in the direction of arrow 46 as shown in FIG. 3*b* and the roll of tape 20 is then retained in position in the cavity 40.

As shown in FIGS. 3*c-f* guide means for the tape roll 20 can include fences 41, 43 that slide as indicated by arrows 47,49 shown in FIG. 3*e* so as to be selectively adjustable to allow rolls of tape of different widths, such as 50 mm as shown in FIG. 3*d* or 70 mm wide tape roll as shown in FIG. 3*e* to be held in the housing and to be retained centrally of the housing so that the feed of the tape is centred on the longitudinal axis 45 of the apparatus towards the dispensing outlet and so the adjustment of the fences provides guiding surfaces to keep the tape roll central and straight in the housing.

In one embodiment the fences 41, 43 for the roll of tape include guide means such as rollers 51 shown in FIG. 3*f* which are arranged to ease the rotation of the supply roll of tape 20. In one embodiment the supply roll of tape need not include a core due to the provision of the guide means in the form of the rollers 51 and two larger rollers 53 which may be trapped between the housing parts.

Turning now to FIGS. 4*a* and *b* there is illustrated the route of the tape 4 as it passes through the apparatus towards the dispensing outlet 36. The tape 4 leaves the roll 20 and passes into a guide chute 48 from which it is moved to pass between drive roller 52, which is driven by motor 50, and pinch roller 54. From there the tape 4 passes through an aperture 56 of the cutting station 34 at which there is a cutting blade. There is then provided a heater plate 60 of heater element 38 and the liquid dispensing station 32 before the tape 4 reaches the dispensing outlet 36.

FIGS. 5*a-b* illustrate the feed means of the apparatus in the form of a drive roller 52 and pinch roller 54 assembly in greater detail and the two operating conditions of the same. When the user actuation means trigger 26 is operated, the pinch roller 54, which is rotated on an eccentric bush 64 is moved to an engaged position shown in FIG. 5*a* in which the tape 4 is thereby engaged to be driven by the rotation of the drive roller 52 which is driven by the belt 66 connected to the motor wheel 68. This operation of the feed means is typically at the start of the dispensing of a new length of tape and causes the free end 12 of the tape 4 to be moved out of the dispensing outlet in the direction indicated by arrow 70. When a sufficient quantity of the tape has been dispensed in a sequence of operation of the drive means, the pinch roller returns to a disengaged position shown in FIG. 5*b* and in which condition the tape 4 can pass between the pinch roller 54 and drive roller 52 freely so that the dispensing of the tape at this time is as a result of the engagement of a portion of the tape which has already been dispensed to an item, and relative movement between the item and the apparatus. FIG. 6*a* further illustrates this feed means arrangement including the drive belt 66 arrangement whilst FIG. 6*b* illustrates an alternative arrangement in which the drive belt and drive wheels are replaced by a series of gear wheels 67, 69, 71 which mesh so as to allow the rotational drive from the motor to be transferred to the tape drive wheel shaft in relation to which the gear wheel 71 is mounted and so provide the drive force for the tape through the apparatus in the direction of arrow 73 to the dispensing outlet 36 and also illustrates the cutting station 34 which includes a blade 58 which is driven to move linearly as indicated by arrow 62 and to move through the tape 4 when passing through the aperture 56 to cut the tape at that location. The movement of the blade is driven by a guillotine lever 72 which is driven by eccentric drive shaft of motor 74 and the operation of the same is caused by the operation of the user actuation means trigger 26 at a time after the same has been used to operate the motor 50 to dispense the leading end 12 of the tape through the dispensing outlet so that, in the dispensing of each length of tape there are two operations of the user actuation means trigger 26, the first to dispense the leading end 12 of the new length of tape and the second to cut through the tape and hence define the trailing end of the said length of tape.

In one embodiment, the apparatus can include a feed length dial 100, shown in FIG. 4*b*, which allows the user to select the length of tape which is to be dispensed.

Figure 7B:
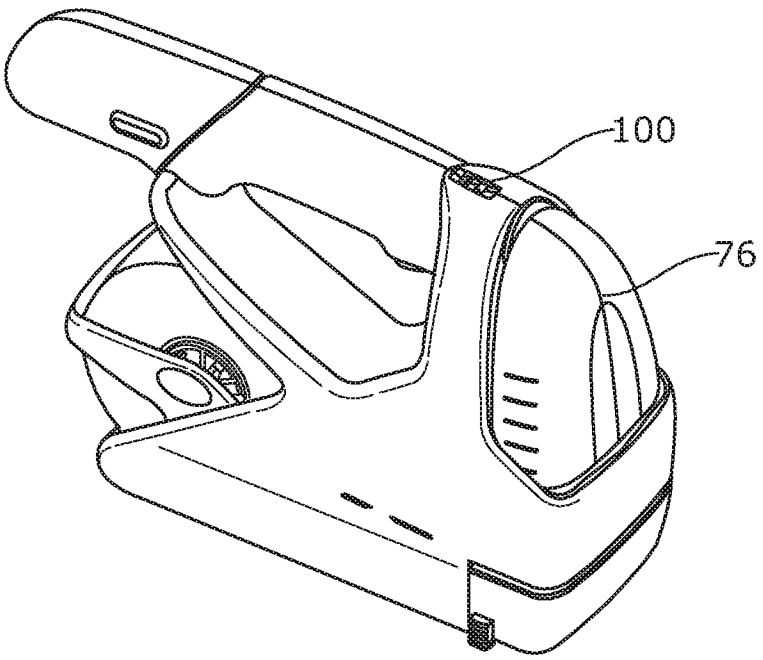
Figure 7A:
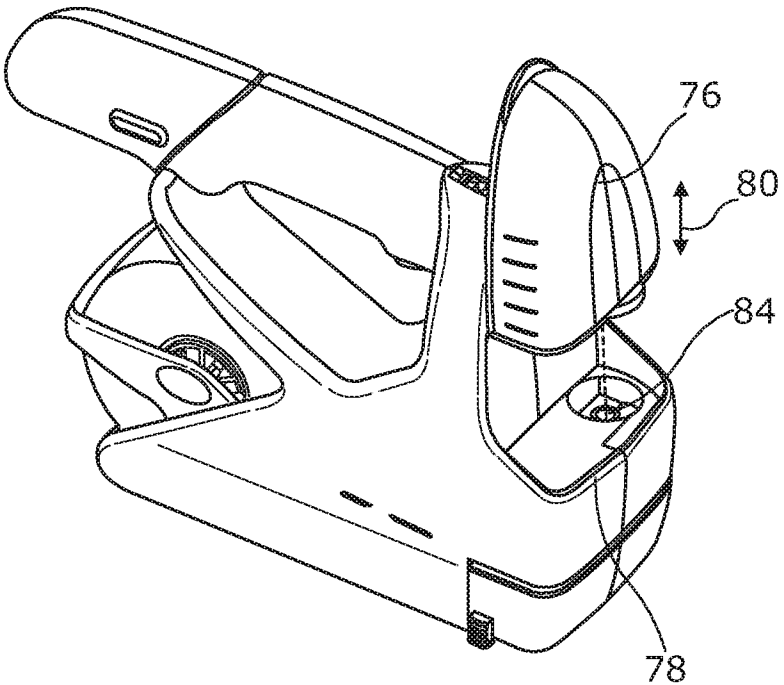
Figure 7D:
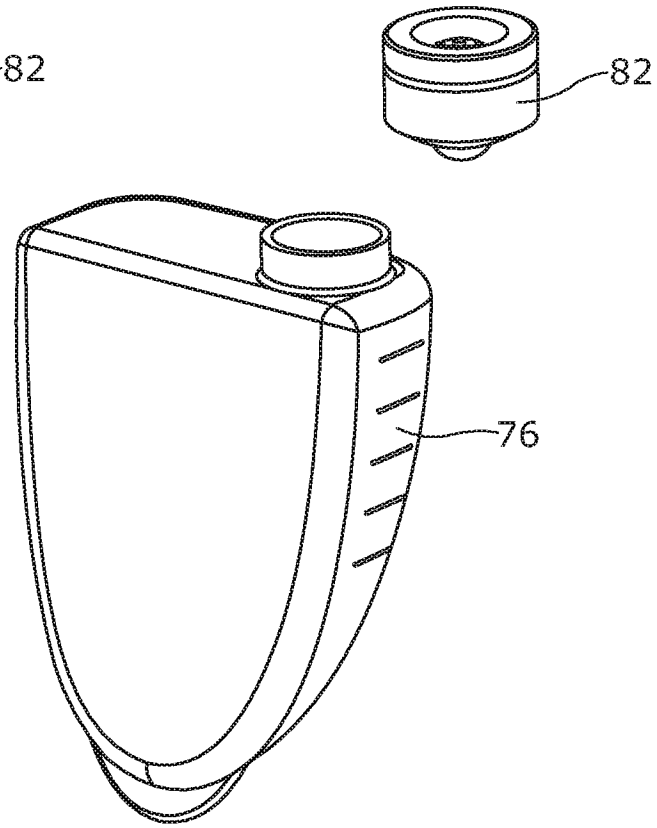
Figure 7C:
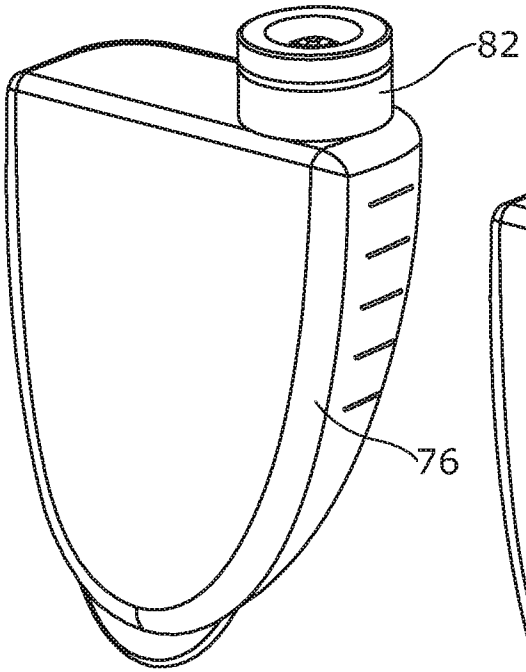
Figure 7E:
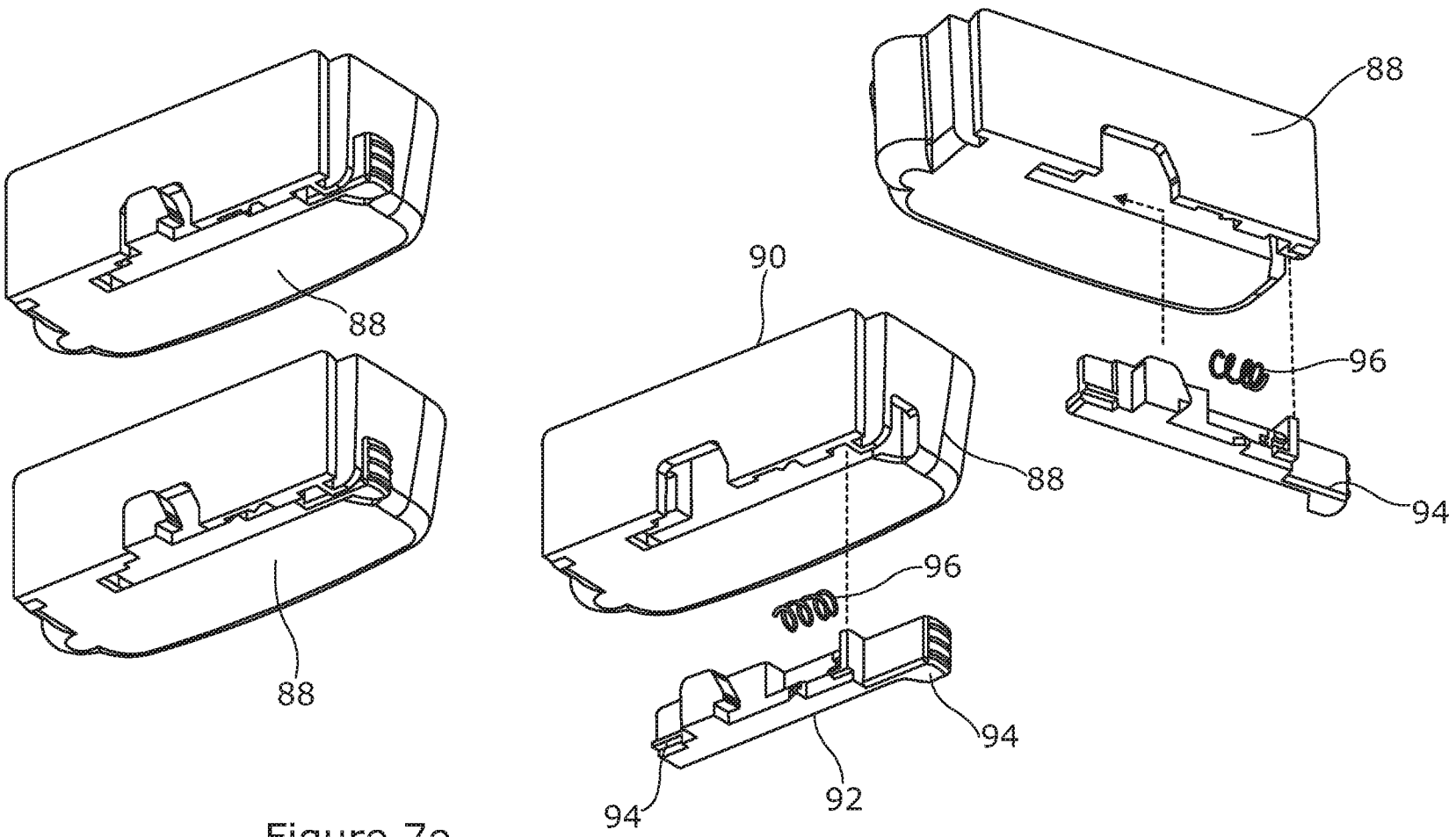
Figure 7F:
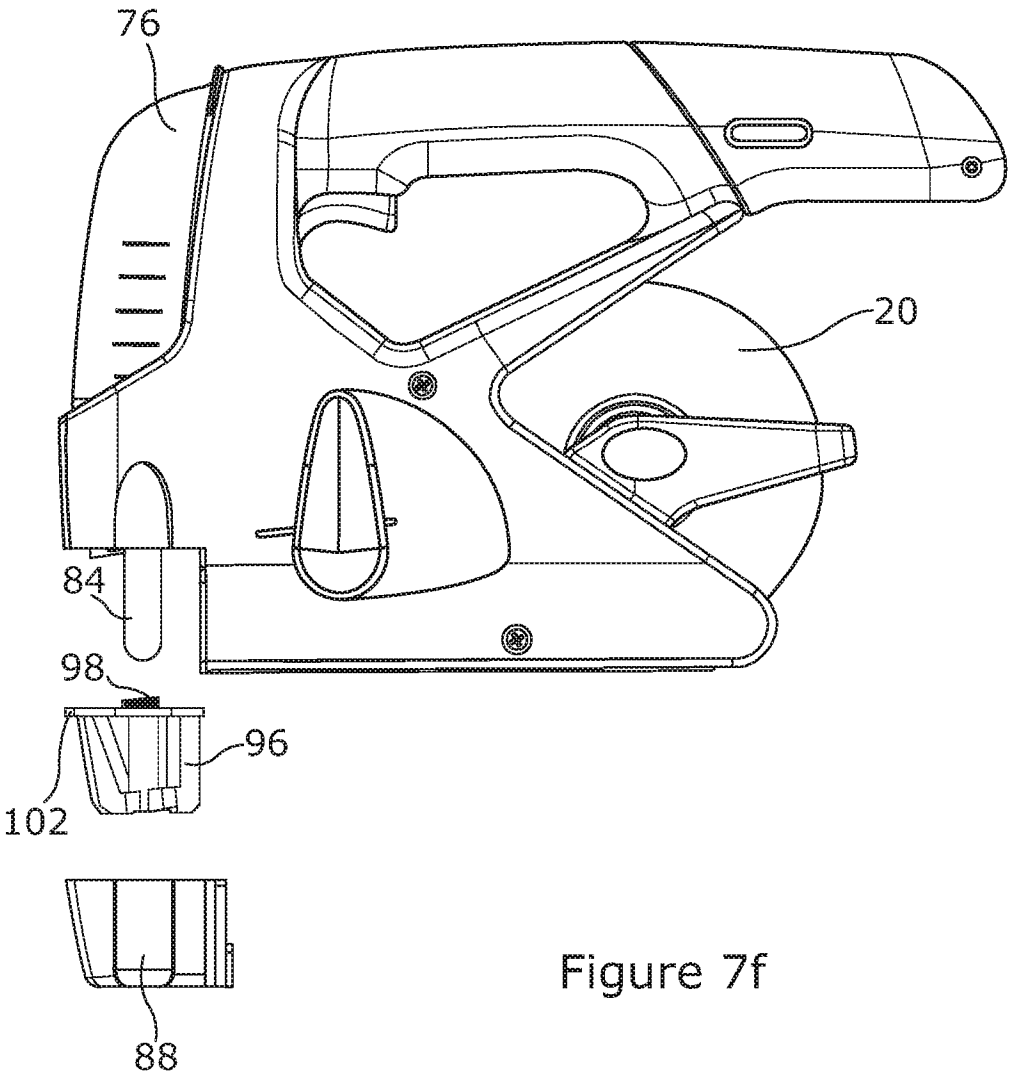
Figure 7F:
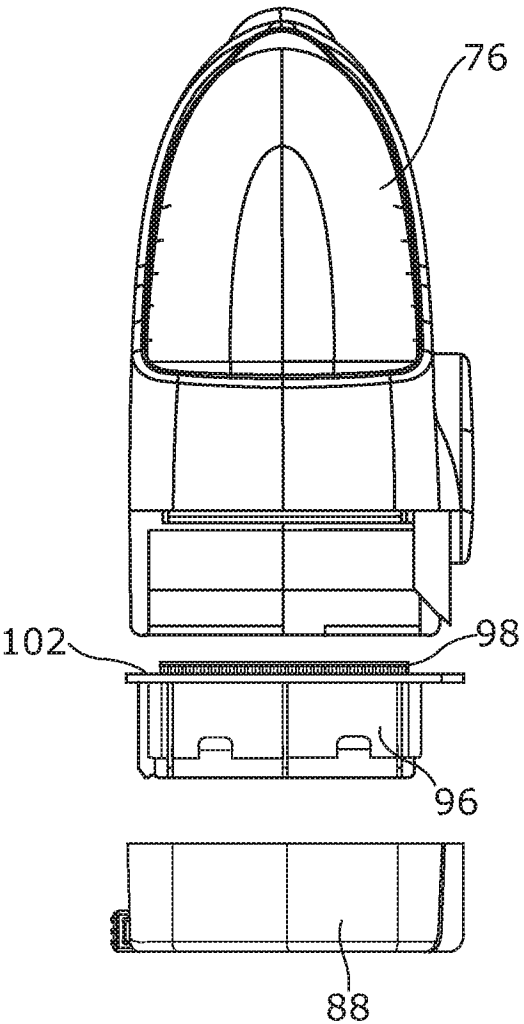
Figure 7G:
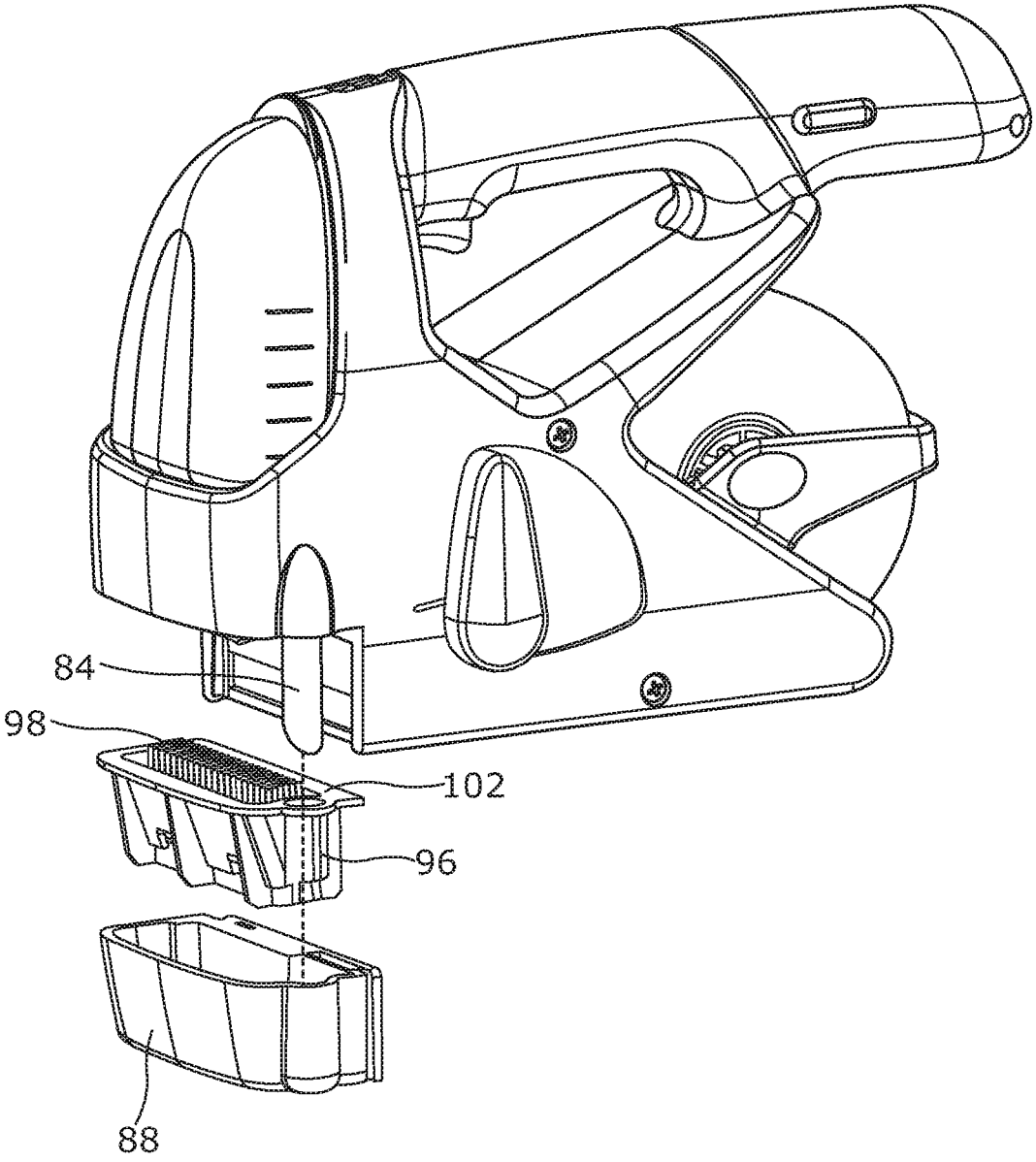
Figure 7I:
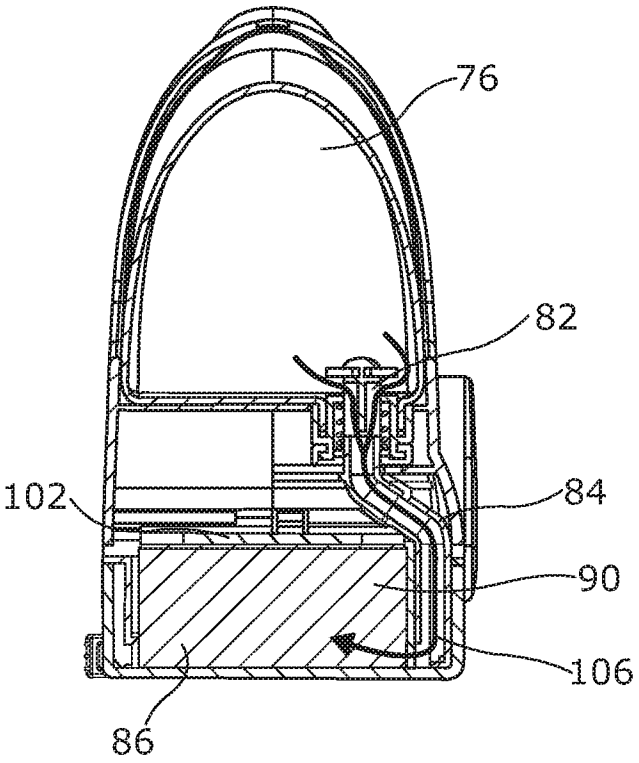
Figure 7H:
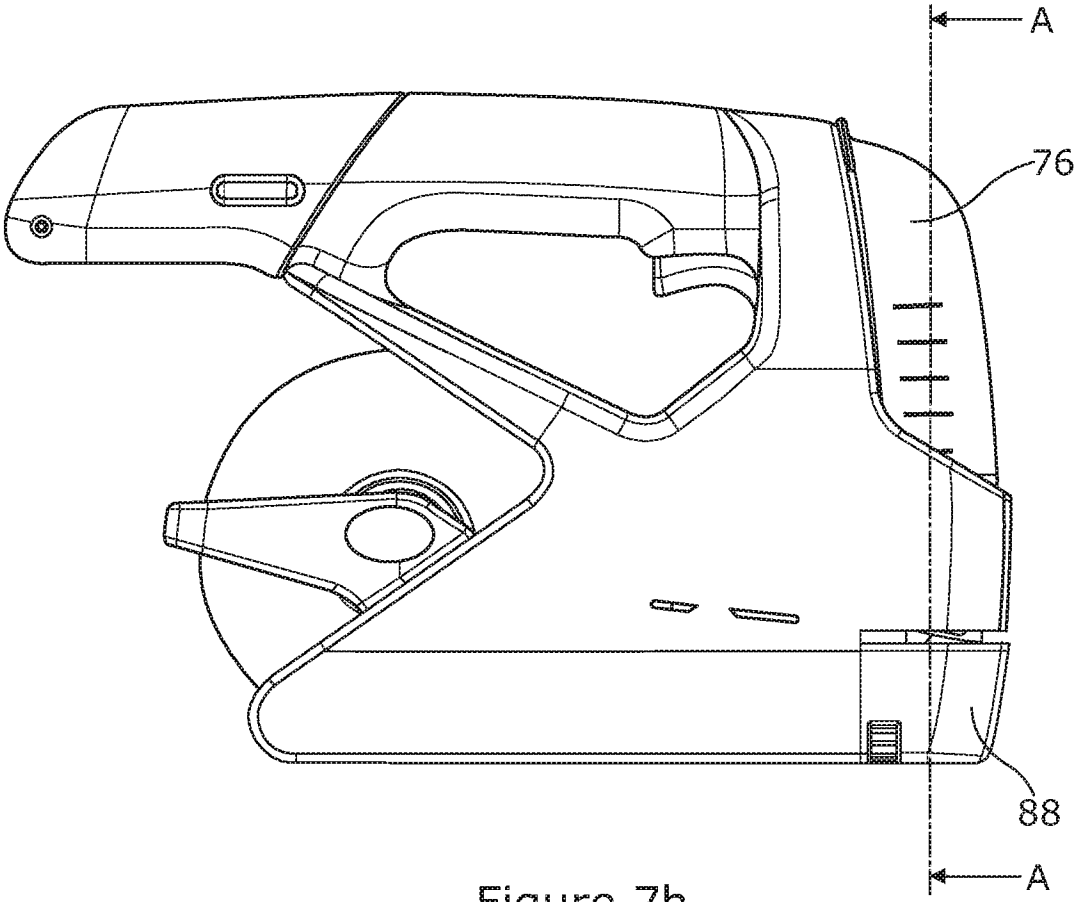
Figure 7K:
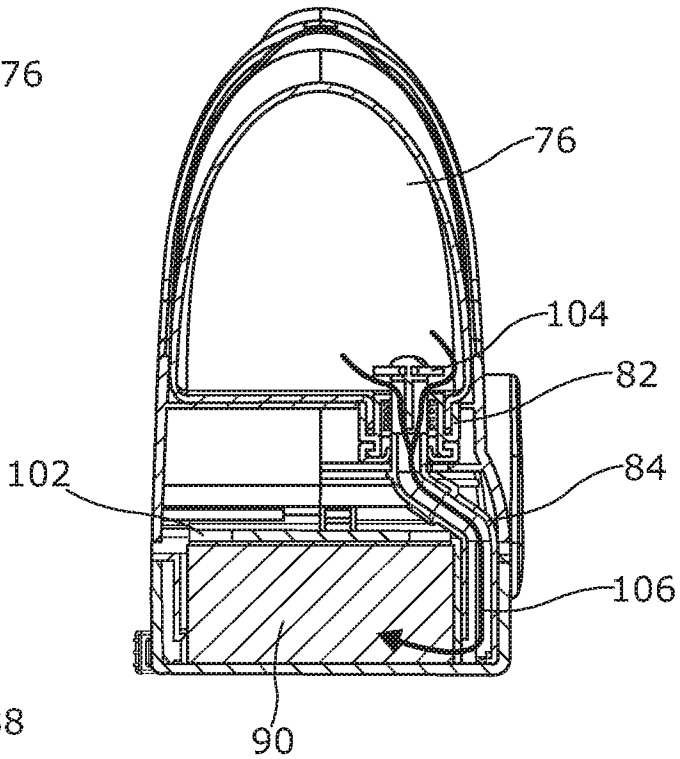
Figure 7J:
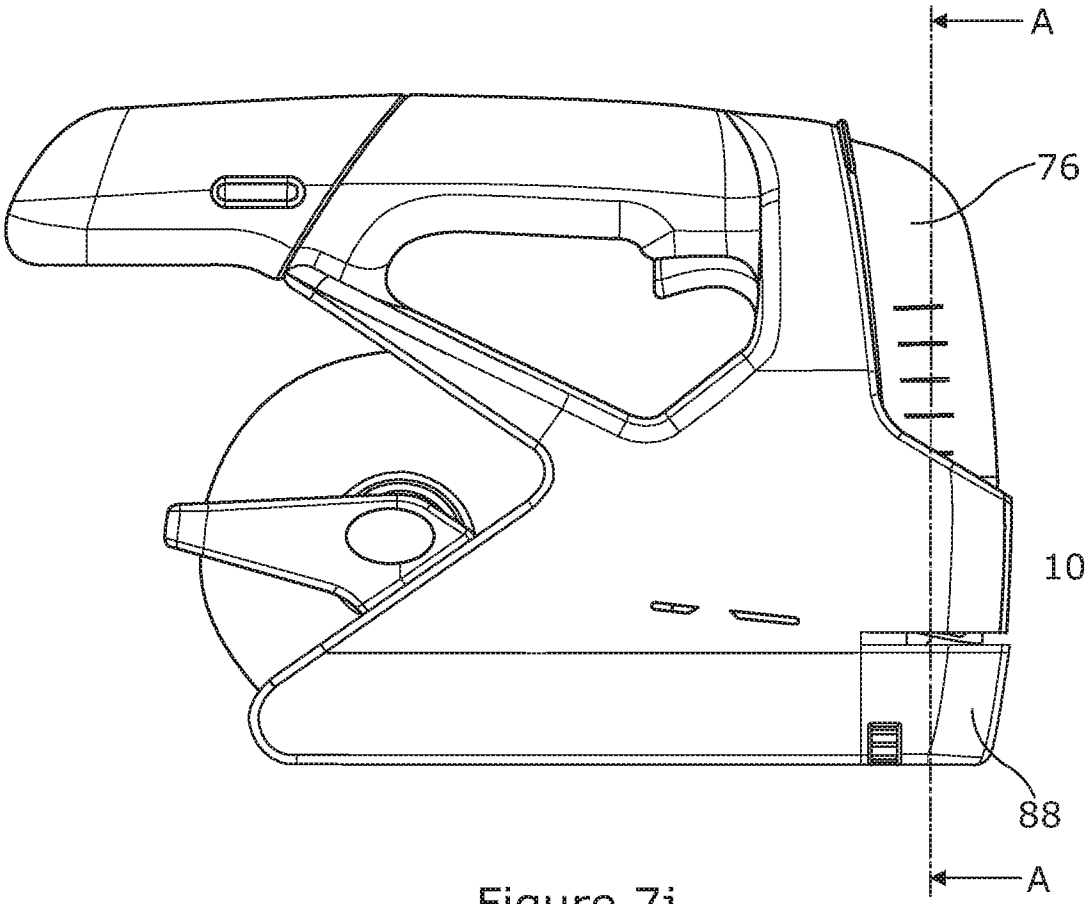

FIGS. 7*a-k* illustrate the water dispensing station 32 in greater detail. The station includes a reservoir 76 which is received in a base 78 of the apparatus. The reservoir can be slidingly fitted into position as illustrated by arrow 80 and, when removed from the apparatus, can be inverted as shown in FIGS. 7*c* and *d* and the cap 82 is removed to allow water to be poured into the reservoir to fill the same. When filled, the cap 82 is refitted, the reservoir is turned round and the cap 82 is positioned to fit onto a receiving tube 84 in the base 78 which acts to open a valve 104 in the cap to allow "on-demand" water to flow from the reservoir, through the cap and into the tube 84 and into a sump assembly 86 shown in detail in FIGS. 7*e-g*. The sump assembly includes a retainer 88 with a cavity 90. A locking bar 92 with retaining lugs 94, and at least one of which is biased to a locking position by spring 96 is provided to releasably retain a brush chassis 96 in the cavity 90. The brush chassis includes a brush 98 which is exposed at the face 102 to allow water which is absorbed and held by the brush, to contact with the tape 4 surface and, in particular the coating of adhesive on the surface, as it is moved past the brush towards the dispensing outlet. The application of the liquid onto the coating activates the adhesive and causes the tape to become an adhesive tape as it is dispensed from the apparatus.

The liquid from the reservoir passes into the tube 84 as shown in FIGS. 7*h-k* from the cap 82 when the valve 104 is opened and passes along the tube 84 as indicated by arrow 106 into the cavity 90 and brush chassis of the retainer where it contacts with the brush 98 and passes along the bristles of the same to be present at the surface 102 and so be available to be applied to the tape adhesive coating as it passes the brush and activate the same.

In one embodiment the housing can include a removable service hatch located so as to allow access to the components located in the housing for repair and/or cleaning. In one embodiment as shown in FIGS. 8*a* and *b* the same or a further access portion 108 is provided to be selectively removable from the housing as indicated by arrow 110 to allow user access to a slot 112 connected to a space below the cutting station guillotine blades and so allow the user to remove any shavings of paper which have been created from the roll of tape when the cutting operations have been performed over time.

In order to maintain the motor in a good operating condition it is important to prevent overloading or unbalanced application force from the same during use. In FIGS. 9*a-g* there is illustrated an embodiment of the jockey wheel arrangement which can selectively be positioned to contact with the tape as it passes through the apparatus. The jockey wheel 116 is mounted on a shaft 118 for rotation about the longitudinal axis 120 and the shaft is located at opposing ends with an actuator 122 at one end and a compensation spring 124 at the other end and which in turn are mounted in the housing 22 so that the longitudinal axis 120 extends across at least part of the width of the housing.

Figures 9A, 9B, 9C, 9D, 9E:
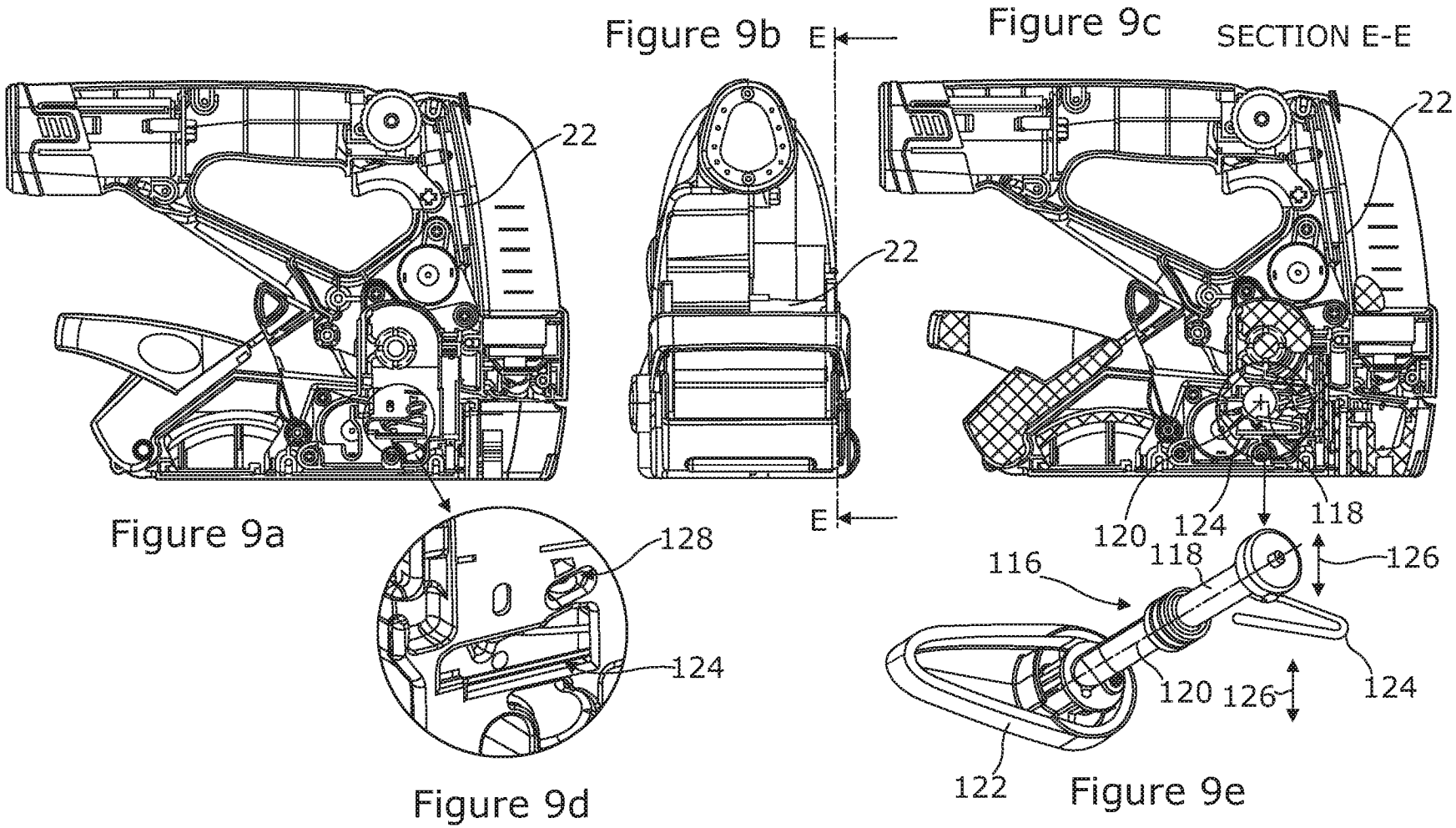
Figure 9F:
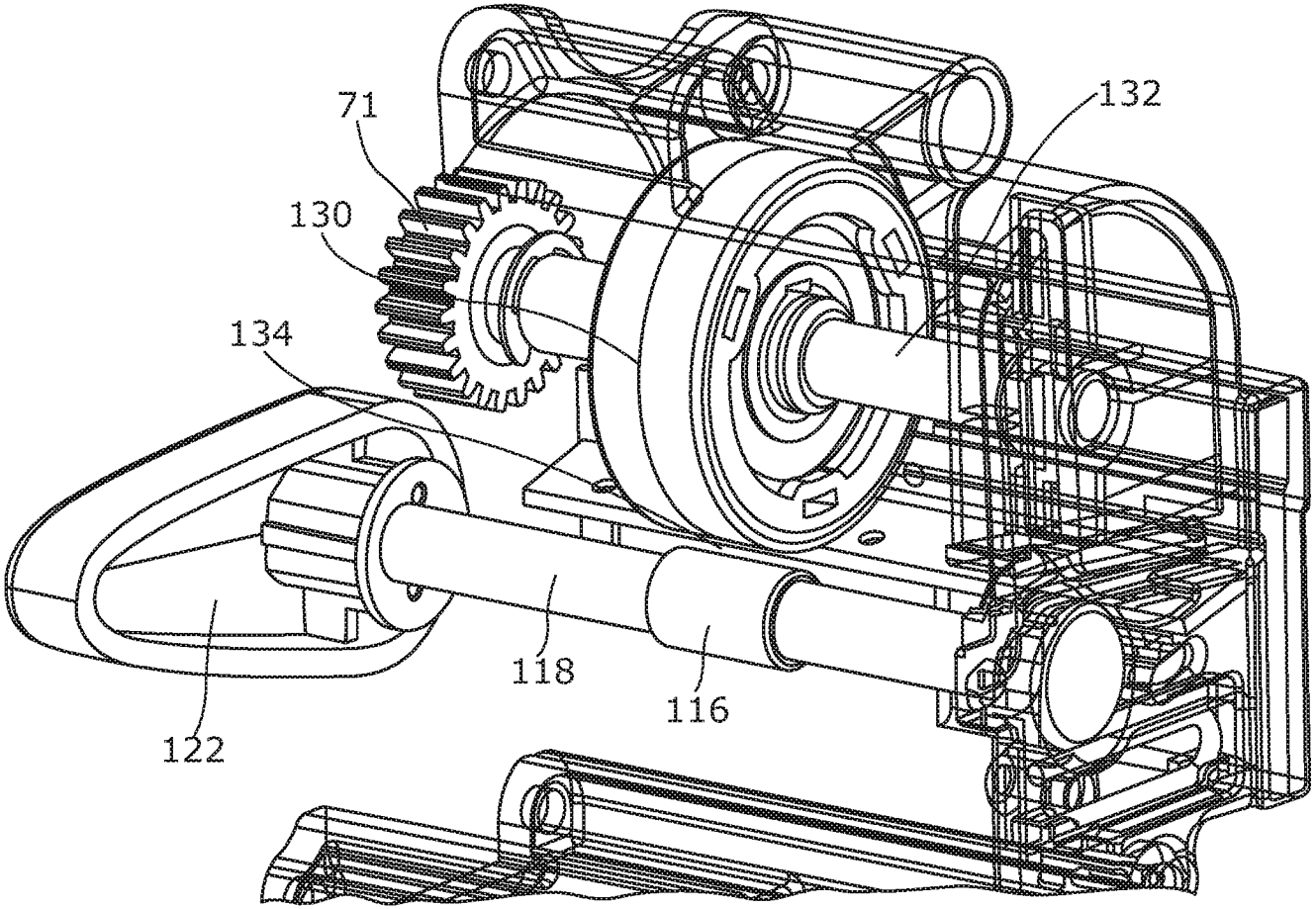
Figure 9G:
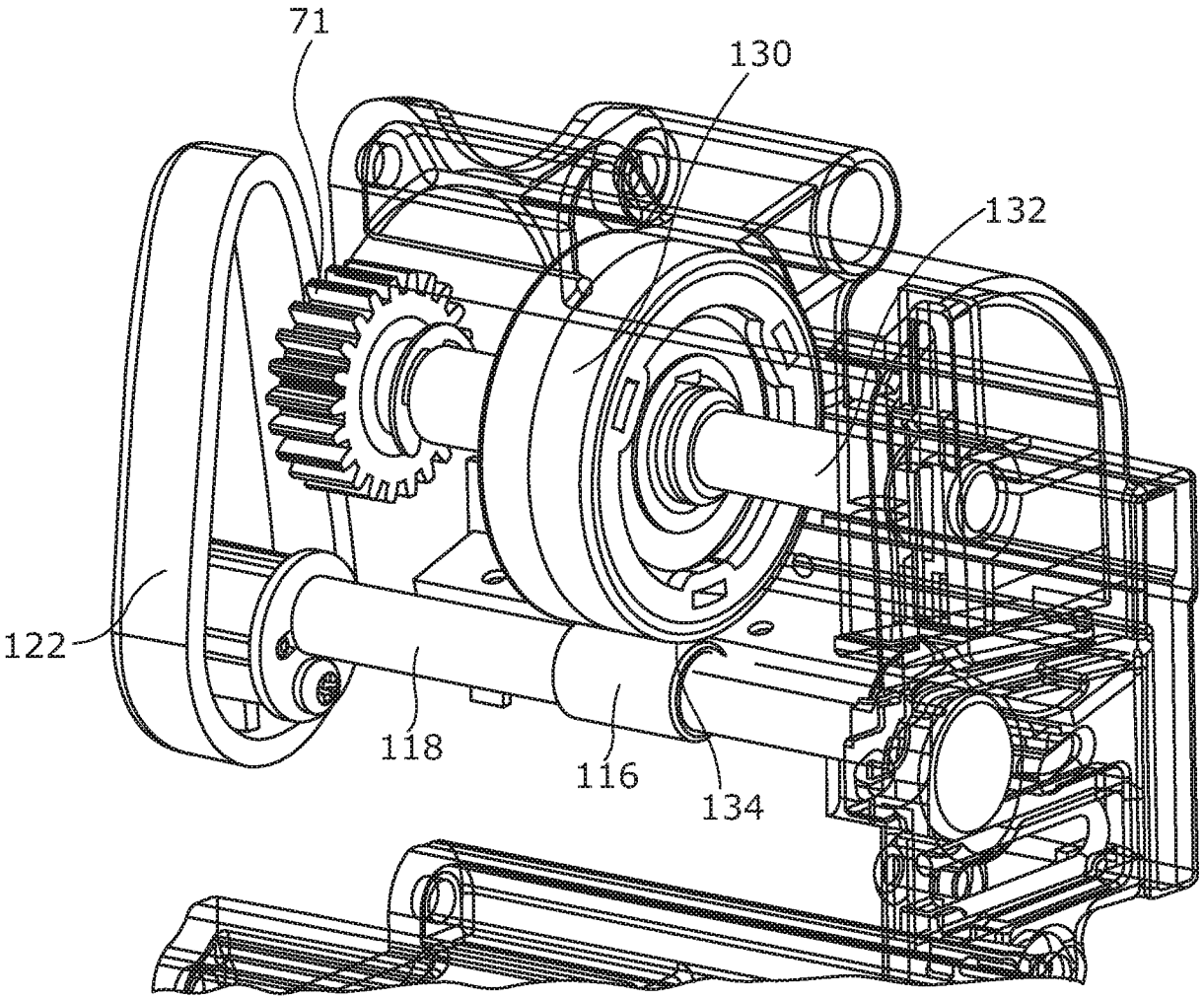

The spring 124 acts to determine the maximum closing pressure between the paper drive and the jockey wheel 116 by allowing limited movement of the shaft at the end at which the spring 124 is mounted as indicated by arrows 126 compensating for tolerance variations, different tape thicknesses and misuse and hence minimising the risk of over stressing of the drive mechanism especially when the pinch roller is engaged as is illustrated with regard to FIGS. 9*f-g*.

The jockey wheel 116 is provided to act on one side of the tape as it is dispensed and on the opposing side of the tape there is mounted the pinch roller 130 which is connected to be driven by the gear wheel 71 via shaft 132. The shaft 118 and jockey wheel are eccentrically mounted so that rotation of the actuator 122 causes movement of the jockey wheel assembly between the retracted position as shown in FIG. 9*f* in order to allow the tape to freely move through the gap 134 between the pinch roller 130 and the jockey wheel 116, and an engaged position shown in FIG. 9*g* in which the gap 134 is reduced and the pinch roller contacts the tape and is driven so as to drive the tape though the gap and the housing.

A spring 128 may also be provided to act on a cutting blade at the cutting station in order to maintain the shear pressure between the two blade edges.

There is therefore provided an applicator apparatus which allows a required length of tape to be dispensed and activated into an adhesive condition whilst the apparatus is hand held and for the tape to be applied to an item in a substantially hands free manner. This significantly increases the possible uses of the apparatus whilst maintaining the ability for the apparatus to be used to meet relatively high volume application requirements.

The invention claimed is:

1. A hand held apparatus for the supply, activation and dispensing of a length of adhesive tape, said apparatus comprising:

feed means in order to move a leading end of the said length of tape away from a tape supply held in a cavity in a housing of the apparatus and towards a dispensing outlet, a liquid application station to allow liquid to be applied to an adhesive coating on the said adhesive tape as it passes said station, a cutting station to selectively cut the tape to define the said length of adhesive tape, said liquid application station and cutting station located intermediate the said tape supply and the dispensing outlet; and user actuation means are provided and located adjacent to a handle portion of the housing to allow selective operation of the feed means to sequentially move the said leading end through the dispensing outlet followed by operation of the cutting station to define the said length of adhesive tape with liquid applied to the said adhesive coating of the same, said liquid application station including a reservoir received in a base of the housing, said reservoir including a cap in connection with a receiving tube leading to a sump assembly located in the base, said sump assembly including a cavity and a brush chassis with a brush, wherein said reservoir is located at a first side of the length of tape and the said sump assembly is located at a second side of the said length of tape opposing said first side, and said tube passes through said housing between said first and second sides and, when located with said cap, opens a valve in the cap to allow liquid to flow from the reservoir, through the tube, into the said cavity and along the bristles of the brush to be available to be applied from the bristles to activate the said adhesive coating on the said second side of the length of tape as it passes to the dispensing outlet.

2. The hand held apparatus according to claim 1 wherein following operation of the user actuation means and the dispensing of the leading end of the length of tape from the apparatus the feed means are disengaged and relative movement of the apparatus with respect to an item to which the leading end of the tape is adhered, allows the dispensing of the said length of tape from the apparatus.

3. The hand held apparatus according to claim 1 wherein a further operation of the user actuation means causes operation of the cutting station to separate the length of tape from the tape supply.

4. The hand held apparatus according to claim 1 wherein drive means is used to operate the feed means and the cutting station.

5. The hand held apparatus according to claim 1 wherein the liquid application station is located intermediate of the cutting station and the dispensing outlet.

6. The hand held apparatus according to claim 1 wherein the tape supply is located by a carrier which is moveable from an open position to a closed position and when in the open position, the carrier acts as a carrier for the said tape supply and when the carrier and a new roll of tape supported thereby are moved to a closed position, the roll of tape is moved into the cavity to the required location for use with the apparatus.

7. The hand held apparatus according to claim 1 wherein the user actuation means operates a clutch system connected to drive means in the form of a motor to selectively connect and disconnect the motor from the feed means.

8. The hand held apparatus according to claim 7 wherein when the motor is engaged the feed means move the leading edge of the tape through the dispensing outlet by driving rollers and, when the motor is disengaged, the rollers are freewheeling to allow the tape to be dispensed from the apparatus by relative movement of the apparatus and an item to which the tape is adhered.

9. The hand held apparatus according to claim 8 wherein a greater part of the said length of tape is dispensed from the apparatus as a result of the relative movement between the apparatus and the item than the length which is dispensed by the driven movement of the tape through the apparatus.

* * * * *